US009194383B2

(12) United States Patent
Knobel

(10) Patent No.: US 9,194,383 B2
(45) Date of Patent: Nov. 24, 2015

(54) DEVICE AND METHOD FOR PUMPING FLOWABLE MASSES

(75) Inventor: Alex Knobel, Curitiba (BR)

(73) Assignee: HAAS-MONDOMIX B.V., Almere (NL)

( * ) Notice: Subject to any disclaimer, the term of this patent is extended or adjusted under 35 U.S.C. 154(b) by 718 days.

(21) Appl. No.: 13/382,004

(22) PCT Filed: Jul. 1, 2010

(86) PCT No.: PCT/IB2010/001606

§ 371 (c)(1), (2), (4) Date: Apr. 12, 2012

(87) PCT Pub. No.: WO2011/001267

PCT Pub. Date: Jan. 6, 2011

(65) Prior Publication Data

US 2012/0189475 A1 Jul. 26, 2012

Related U.S. Application Data

(60) Provisional application No. 61/222,541, filed on Jul. 2, 2009.

(51) Int. Cl.

| | |
|---|---|
| ***F04B 7/04*** | (2006.01) |
| ***F04B 7/06*** | (2006.01) |
| ***F04B 3/00*** | (2006.01) |

(Continued)

(52) U.S. Cl.

CPC ..... *F04B 15/02* (2013.01); *F04B 7/045* (2013.01); *F04B 15/023* (2013.01); *F04B 23/026* (2013.01); *F04B 3/00* (2013.01)

(58) Field of Classification Search

CPC ..... F04B 23/026; F04B 15/02; F04B 15/023; F04B 3/00; F04B 7/045; F04B 13/00; F04B 13/02; F15B 15/16; F15B 15/1409

USPC ..... 417/53, 486–488, 490, 493, 494, 498, 417/509, 534–536; 92/52

See application file for complete search history.

(56) References Cited

U.S. PATENT DOCUMENTS

| | | | | |
|---|---|---|---|---|
| 2,397,106 | A * | 3/1946 | Haller | 91/168 |
| 4,150,759 | A * | 4/1979 | Bell, Jr. | 414/187 |
| 5,507,626 | A * | 4/1996 | Yang | 417/258 |

(Continued)

FOREIGN PATENT DOCUMENTS

| | | | |
|---|---|---|---|
| CN | 101290002 | A * | 10/2008 |
| DE | 10 2004 041 365 | A1 | 3/2006 |

(Continued)

*Primary Examiner* — Peter J Bertheaud

(74) *Attorney, Agent, or Firm* — Laurence Greenberg; Werner Stemer; Ralph Locher

(57) ABSTRACT

A device for pumping a flowable mass, such as a consumable item, has a main body with a hollow space that is fluidically connected with a mass source through an inlet opening and with a mass destination through an outlet opening in the surroundings of the main body. The inlet opening and the outlet opening are disposed along a direction at a distance from each other on the main body. A first body and a second body can each be moved in the hollow space relative to the main body and relative to each other along the direction. The first and second bodies are sealed against an inside wall and slidable on the inside wall to define a chamber. Moving the first body and/or the second body varies the volume of the chamber and its position relative to be main body.

6 Claims, 8 Drawing Sheets

(51) Int. Cl.
*F04B 15/02* (2006.01)
*F04B 23/02* (2006.01)

(56) References Cited

U.S. PATENT DOCUMENTS

| | | | | |
|---|---|---|---|---|
| 5,639,220 | A * | 6/1997 | Hayakawa | 417/53 |
| 7,618,251 | B2 | 11/2009 | Steiner et al. | |
| 2007/0261677 | A1 * | 11/2007 | Bennion | 123/51 R |
| 2008/0110927 | A1 * | 5/2008 | Steiner et al. | 222/71 |
| 2010/0140289 | A1 * | 6/2010 | Knobel et al. | 222/1 |
| 2010/0291269 | A1 | 11/2010 | Ouriev | |
| 2010/0303656 | A1 * | 12/2010 | Lin et al. | 417/496 |

FOREIGN PATENT DOCUMENTS

| | | | | |
|---|---|---|---|---|
| DE | 10 2005 004 785 | A1 | 9/2006 | |
| DE | 10 2007 024 028 | A1 | 11/2008 | |
| EP | 0 369 991 | A1 | 5/1990 | |
| GB | 2 226 612 | A | 7/1990 | |
| WO | WO 2008089949 | A1 * | 7/2008 | B05C 5/02 |

* cited by examiner

DEVICE AND METHOD FOR PUMPING FLOWABLE MASSES

BACKGROUND OF THE INVENTION

Field of the Invention

The invention relates to a device and a method for pumping a flowable mass, in particular a consumable item, e.g. viscous fat masses.

Devices for pumping such masses are known. They comprise a pump chamber with an inlet opening and an outlet opening. In the pump chamber a piston can be moved to and fro. By moving the piston in the first direction (movement forwards) the mass can be sucked into the pump chamber by way of the inlet opening. By moving the piston in the second direction (movement backwards) the mass can be discharged from the pump chamber by way of the outlet opening. The pump housing and the piston can be of different designs. Depending on the design, the piston movement in the interior of the pump chamber is a straight-line displacement of the piston along a displacement axis, or is a rotary movement of the piston on a rotary axis. In this arrangement, opening and closing the inlet opening and the outlet opening needs to be coordinated with the movements of the piston. Depending on the design, opening and closing these openings takes place by means of a slide valve or a rotary valve. In the case of a matched shape of the piston and the pump chamber, the functions of sucking in and discharging mass, and opening and closing the openings, can also be achieved by a combination of straight-line piston movement and rotary movement of the piston. In this context this is referred to as a "reciprocating/rotary piston".

However, such devices are expensive because the piston and the valves need to be driven separately, or a complicated reciprocating/rotary movement of such a reciprocating/rotary piston needs to be generated.

Furthermore, in devices of this kind the inlet opening and the outlet opening are, as a rule, quite narrow. In the case of highly-viscous masses this is disadvantageous. In order to achieve acceptable pumping capacity, it is then necessary to operate with substantial pumping forces. This requires larger dimensioning of the device and greater expenditure of energy during pumping.

It is the object of the invention to overcome the above-mentioned disadvantages of the known devices.

PRESENTATION OF THE INVENTION

In order to meet the above object, the invention provides a device for pumping a flowable mass, with the device comprising:

- a main body having a hollow space, which is in fluid connection with a mass source by way of an inlet opening and with a mass destination by way of an outlet opening in the surroundings of the main body, wherein the inlet opening and the outlet opening are disposed along a direction (L) at a distance from each other on the main body;
- a first body and a second body, both of which can be moved in the main body hollow space relative to the main body and relative to each other along the direction (L), wherein both the first body and the second body rest sealingly against an inside wall and slidingly against said inside wall, wherein by moving the first body and/or the second body, both the volume of the chamber and the position thereof relative to, or in, the main body can be varied.

The two bodies that can be moved relative to each other and relative to the main body make it possible to achieve a simple design of the device. The volume of the chamber within the main body can be varied by moving at least one of the two bodies, and the position of the chamber within the main body can be varied by moving both bodies. Thus the chamber can be brought to fluid connection with the inlet opening or with the outlet opening. Furthermore, the inlet opening or the outlet opening can be blocked in that one of the bodies is positioned in front of this opening. Since the first body and the second body in each case rest sealingly against an inside wall and slidingly against said inside wall, they can in a slide-like manner block openings provided on said inside wall. The chamber volume can be enlarged in order to cause a suction effect into the chamber in that the two bodies are moved away from each other, or the chamber volume can be reduced in order to cause a discharge effect out of the chamber in that the two bodies are moved towards each other.

The device according to the invention distinguishes itself not only by its simple design, but also by its ability to be used in a very flexible manner for various tasks. Since the two bodies can be moved independently of each other, many different effects can be achieved by the device. For example, it is readily possible to achieve a suction effect or a discharge effect both at the inlet opening and at the outlet opening, and consequently the direction of pumping or conveying can be reversed. Likewise, changing the pumping volume per cycle or the pump stroke can readily be changed in that the minimum distance and the maximum distance between the two bodies is determined accordingly.

In order to set the time-dependent positioning, necessary for the aforesaid, of the first and of the second body, the first body and the second body can each be connected to a servomotor drive. The excellent positioning accuracy, reproducibility and programmability of servomotors can thus be directly transferred to the device according to the invention.

Instead of servomotors, it is also possible to provide pneumatic drives for the back-and-forth movement of the first body and of the second body. Preferably, in this case the device comprises end stops for limiting the movement of the two bodies. In particular, for each of the two bodies an end stop for limiting its movement forwards, and an end stop for limiting its movement backwards can be provided. While due to the elasticity of such a pneumatic drive the chronological sequence of the movement of the two bodies between their two extreme positions varies, the pump stroke or the pumping volume per pump cycle however doesn't vary. In many applications in which the pumping volume or the dosing accuracy and the total time of a pumping cycle between sucking in and discharging a defined volume of the flowable mass are predetermined, pneumatic drives are thus sufficient.

Driving the forwards movement and the backwards movement of the two bodies can also take place in that with the use of a spring means each of the bodies is pushed in a direction (e.g. in the direction of its movement forwards, or in the direction of its movement backwards) and with the use of a cam means, eccentric means or the like is moved in the opposite direction (i.e. in the direction of its movement backwards or in the direction of its movement forwards) against the force of the spring means. The spring means can be a pneumatic spring arrangement or a spring arrangement comprising coil springs, leaf springs, membrane springs or the like.

Expediently, a multitude of devices according to the invention are provided, which devices are connected in parallel. In this arrangement all the devices are connected in parallel by means of a first transverse link and a second transverse link and are driven in parallel, wherein the first body of the respective device is driven by way of the first transverse link ("pump bar", "piston bar", "nozzle bar", etc.) together with the first bodies of the other devices, and the second body of the respective device is driven by way of the second transverse link ("pump bar", "piston bar", "nozzle bar", etc.) together with the second bodies of the other devices. In this arrangement the first transverse link and the second transverse link are driven by means of a first drive or by means of a second drive. These drives can, for example, be selected from one of the design types mentioned above. In this arrangement, for both bodies, drives of an identical design type or of a different design type can be used. In particular, for the first bodies a hard-elastic, i.e. quasi-rigid or "hard" drive can be used, e.g. a servomotor, a cam drive or an eccentric drive, while for the second body a soft-elastic, e.g. flexible or "soft" drive can be used, e.g. a pneumatic drive.

According to a first embodiment of the device according to the invention, the hollow space of the main body comprises a channel with a constant channel cross section; the first body and the second body are designed as sliding bodies that extend over the entire channel cross section and rest sealingly against the inside wall of the main body channel and slidingly against said inside wall; and the two sliding bodies in the channel are movable independently of each other along a line that extends along the longitudinal direction of the channel, so that between the two sliding bodies a chamber is defined whose volume and/or position relative to the main body can be varied by moving the two sliding bodies independently of each other along the longitudinal direction of the channel.

This serial arrangement of the sliding bodies (see FIG. 1A) makes it possible to provide the three main elements of the device, namely the main body with the channel, the first sliding body and the second sliding body in a particularly simple design, namely: the main body, e.g. as a channel with a constant cross section and two openings (inlet and outlet) spaced apart along the channel direction, and two identically formed sliding bodies whose cross section is identical with the cross section of the channel.

According to a second embodiment of the device according to the invention, the hollow space of the main body comprises a main body channel with a constant channel cross section; wherein the first body is designed as a first sliding body that comprises a first longitudinal section that extends over the entire cross section of the main body channel and rests sealingly against the inside wall of the main body channel and slidingly against said inside wall; and wherein the first sliding body comprises a second longitudinal section that comprises a sliding body channel with a constant channel cross section; wherein the second body is designed as a second sliding body that has a longitudinal section that extends over the entire cross section of the sliding body channel of the second sliding body and rests sealingly against the inside wall of the sliding body channel and slidingly against said inside wall, and in that the two sliding bodies are movable independently of each other in the channel along a line that extends along the longitudinal direction of the channel so that between the two sliding bodies a chamber is defined whose volume and/or position relative to the main body can be varied by moving the two sliding bodies independently of each other along the longitudinal direction of the channel.

This telescopic arrangement of the sliding bodies (see FIG. 2A) makes it possible to provide the three main elements of the device, namely the main body with the channel, the first sliding body and the second sliding body in a particularly simple and compact design, namely: the main body e.g. as a channel with a constant cross section and two openings (inlet and outlet) spaced apart along the direction of the channel, and a first sliding body whose outside cross section is identical with the cross section of the channel and which in its interior also comprises a channel, a so-called sliding body channel, as well as a second sliding body, whose outside cross section is identical with the cross section of the sliding body channel, wherein the first sliding body comprises two openings of which the first sliding body opening can be lined up with the inlet opening of the main body, and the second sliding body opening can be lined up with the outlet opening of the main body. This second embodiment supports the same functions with the same types of drives as does the first embodiment.

According to a third embodiment, the device according to the invention comprises a main body with a hollow space that by way of a first inlet opening is in fluid connection with a first mass source and by way of a second inlet opening is in fluid connection with a second mass source, and wherein said main body by way of a first outlet opening and by way of a second outlet opening is in fluid connection with a mass destination in the surroundings of the sliding body, wherein on the one hand the first inlet opening and the second inlet opening are disposed along a direction at a distance from each other on the main body, and wherein on the other hand the first outlet opening and the second outlet opening are disposed along the direction at a distance from each other on the main body. Furthermore, this embodiment comprises a first body, a second body and a third body, wherein the first body, the second body and the third body can be moved in the main body hollow space relative to the main body and relative to each other along said direction, and rest sealingly against an inside wall and slidingly against said inside wall. The first body and the second body delimit a first chamber, wherein by moving the first body and/or the second body both the volume of the first chamber and the position thereof relative to, or in, the main body can be varied. The first body and the third body delimit a second chamber, wherein by moving the first body and/or the third body both the volume of the second chamber and the position thereof relative to, or in, the main body can be varied.

This "three-piston arrangement" or "two-piston arrangement" makes it possible to individually drive each of the three movable bodies (sliding bodies or pistons) and thus to individually control the pumping volume and the pumping speed at each of the two chambers. It is possible, with this arrangement, to pump a different mass through each of the three chambers, in other words three different masses, to a destination.

Expediently, in this arrangement with three movable bodies the hollow space of the main body comprises a channel with a constant channel cross section; wherein the first body and the second body are designed as sliding bodies that extend over the entire channel cross section and rest sealingly against the inside wall of the main body channel and slidingly against said inside wall; and wherein the first sliding body and the second sliding body in the channel are movable independently of each other along a line that extends along the longitudinal direction of the channel, so that the volume and/or the position of the first chamber relative to the main body can be varied by moving the two sliding bodies independently of each other along the longitudinal direction of the channel.

In this embodiment one of the two chambers is formed by the serial arrangement, as described above, of the sliding bodies and comprises its advantages.

Preferably, in this arrangement the first body and the third body, too, are designed as sliding bodies that extend over the entire channel cross section and rest sealingly against the inside wall of the main body channel and slidingly against said inside wall; wherein the first sliding body and the third sliding body in the channel are also movable independently of each other along a line that extends along the longitudinal direction of the channel, so that the volume and/or the position of the second chamber can also be altered by independently moving the two sliding bodies relative to the main body along the longitudinal direction of the channel.

In this "double serial" embodiment the two chambers are formed by a serial arrangement of the sliding bodies and both comprise its advantages.

As an alternative, in the arrangement comprising three movable bodies the first body can be designed as a first sliding body that comprises a first longitudinal section that extends over the entire cross section of the main body channel and rests sealingly against the inside wall of the main body channel and slidingly against said inside wall; wherein the first sliding body also comprises a second longitudinal section that comprises a sliding body channel with a constant channel cross section; and wherein the third body is designed as a third sliding body that has a longitudinal section that extends over the entire cross section of the sliding body channel of the first sliding body and rests sealingly against the inside wall of the sliding body channel and slidingly against said inside wall, wherein the first sliding body and the third sliding body are movable independently of each other in the channel along a line that extends along the longitudinal direction of the channel, so that the volume and/or the position of the second chamber relative to the main body can be varied by moving the two sliding bodies independently of each other along the longitudinal direction of the channel.

In this embodiment one of the two chambers is formed by the telescopic arrangement, as described above, of the sliding bodies and comprises its advantages.

Preferably, in this arrangement the second body, too, is designed as a second sliding body that comprises a first longitudinal section that extends over the entire cross section of the sliding body channel and rests sealingly against the inside wall of the sliding body channel and slidingly against said inside wall; wherein the second sliding body comprises a second longitudinal section that comprises a sliding body channel with a constant channel cross section; and wherein a fourth body is provided that is designed as a fourth sliding body, wherein the second body and the fourth body delimit a third chamber; and wherein the fourth sliding body has a longitudinal section that extends over the entire cross section of the sliding body channel of the second sliding body and rests sealingly against the inside wall of the sliding body channel and slidingly against said inside wall, wherein the second sliding body and the fourth sliding body are movable independently of each other in the channel along a line that extends along the longitudinal direction of the channel, so that the volume and/or the position of the third chamber relative to the main body can be varied by moving the two sliding bodies independently of each other along the longitudinal direction of the channel.

In the above "double telescopic arrangement" two of the three chambers are formed within the respective telescopic arrangement of the sliding bodies, and one of the three chambers is formed between the two telescopic arrangements. This arrangement combines the advantages of the serial arrangement with the advantages of the telescopic arrangement. In this embodiment three chambers are provided, for which a total of four sliding bodies are required. Despite its compact design, this arrangement is very versatile in use. As far as driving the sliding bodies and thus the volume and the position of each of the chambers is concerned, in this embodiment there are even four degrees of freedom, which can be implemented by means of a respective independent drive, in particular by means of servomotor drives. In order to further improve the compact design and to obviate the need for one of the four drives, it is also possible to interconnect two of the four drives. This still leaves three degrees of freedom for positioning the sliding bodies, which is adequate in most applications.

In a further advantageous embodiment the hollow space of the main body comprises a channel with a constant channel cross section; wherein the first body and the second body are designed as sliding bodies that extend over the entire channel cross section and rest sealingly against the inside wall of the main body channel and slidingly against said inside wall; and wherein the first sliding body and the second sliding body in the channel are movable independently of each other along a line that extends along the longitudinal direction of the channel, so that the volume and/or the position of the first chamber relative to the main body can be varied by moving the two sliding bodies independently of each other along the longitudinal direction of the channel; and wherein the first body is designed as a first sliding body that comprises a first longitudinal section that extends over the entire cross section of the main body channel and rests sealingly against the inside wall of the main body channel and slidingly against said inside wall; wherein the first sliding body comprises a second longitudinal section that comprises a sliding body channel with a constant channel cross section; wherein the third body is designed as a third sliding body that has a longitudinal section that extends over the entire cross section of the sliding body channel of the first sliding body and rests sealingly against the inside wall of the sliding body channel and slidingly against said inside wall, wherein the first sliding body and the third sliding body are movable independently of each other in the channel along a line that extends along the longitudinal direction of the channel so that the volume and/or the position of the second chamber relative to the main body can be varied by moving the two sliding bodies independently of each other along the longitudinal direction of the channel.

This "serial/telescopic arrangement" of the three sliding bodies (compare FIG. 3A) is a combination of the above-described "serial arrangement" (FIG. 1A) and the above-described "telescopic arrangement" (FIG. 2A). This combination also provides great flexibility, namely also three degrees of freedom of positioning for the three sliding bodies and thus for the two chambers. In particular, it makes possible individual positioning of the three movable bodies, e.g. by means of servomotor drives.

Preferably, in the serial arrangement (first embodiment) the inlet opening is arranged in the region of the inside wall of the main body channel along which the first sliding body is movable. Thus apart from its piston function the first sliding body at the same time carries out the function of a slide for opening and closing the inlet opening. Analogously to this, preferably, the outlet opening is arranged in the region of the inside wall of the main body channel along which the second sliding body is movable. Thus apart from its piston function the second sliding body, too, at the same time carries out the function of a slide for opening and closing the outlet opening.

Preferably, in the telescopic arrangement (second embodiment) the first sliding body comprises a first opening on the sliding body channel and a second opening on the sliding body channel, wherein the first opening in a first position of the sliding body along the longitudinal direction of the channel (L) can be lined up with the inlet opening of the main body so that the chamber in the interior of the main body is in fluid connection with the mass source by way of the inlet opening, and wherein the second opening in a second position of the sliding body along the longitudinal direction of the channel (L) can be lined up with the outlet opening of the main body so that the chamber in the interior of the sliding body is in fluid connection with the mass destination in the surroundings of the main body by way of the outlet opening.

When compared to the state of the art, the device according to the invention supports relatively large inlet openings and outlet openings, which is advantageous in particular for pressure-sensitive masses, for example foamed masses. A maximum diameter $D_E$ of the inlet opening, which diameter extends orthogonally to the movement line (L), can have a value that is in the region of 1/10 to 10/10 of the maximum diameter of the first body orthogonally to the movement line (L) along which the first body is movable in the main body hollow space relative to the main body. Analogously, a maximum diameter $D_A$ of the outlet opening, which diameter extends orthogonally to the movement line (L), can have a value that is in the region of 1/10 to 10/10 of the maximum diameter of the second body in the serial arrangement, or in the region of 1/10 to 10/10 of the first body in the telescopic arrangement orthogonally to the movement line (L) along which the second body or the first body is movable in the main body hollow space relative to the main body.

Preferably, circular or oval openings are used, wherein their diameter DE or DA ranges from 5/10 to 10/10 of the maximum diameter of the second body or of the first body. This prevents a high fluid resistance along the conveyance path in the interior of the device according to the invention, thus largely preventing "bottlenecks" at which sensitive masses could be damaged. Furthermore, these large opening cross sections make it possible to pump masses that contain larger solid materials, for example chocolate masses comprising whole hazelnuts or nut fractions.

The first body and the second body can have a circular cross section orthogonally to the movement line (L) along which the first body and the second body are movable in the main body hollow space relative to the main body. This geometry is easy to produce and is not prone to interference.

In the device according to the invention the hollow space can be in fluid connection with several fluid sources by way of several inlet openings. By means of a suitable movement of the first and of the second bodies, in this way a mixture of various fluids can be produced during a pumping cycle. Preferably, such inlet openings are spaced apart on the hollow space of the main body along a direction along which the first body and/or the second body are movable. Thus during movement of the two bodies along the movement line (L) at one or several inlet openings a respective fluid can be sucked in that a movement component is imposed on the movement of the two bodies, which movement component increases the distance between the two bodies along the movement line (L). In this way during a pumping cycle consecutively various masses can be sucked in and brought together. It is also possible for inlet openings to be spaced apart on the hollow space of the main body along a direction that extends across, in particular orthogonally to, the direction (L) along which the first body and/or the second body are movable. Thus during a pumping cycle almost concurrently, or concurrently, various masses can be sucked in and brought together.

In the serial arrangement (first embodiment) the main body channel can be a straight-line channel, and the sliding bodies can be straight-line bodies that have been formed so as to be complementary to the channel. In the telescopic arrangement (second embodiment) in a similar manner the main body channel and the sliding body channel of the first sliding body can be straight-line channels, and the first sliding body and the second sliding body can be straight-line bodies. In these cases the movement line (L) is a straight line.

For the function of the device according to the invention it is perfectly adequate if the two bodies are only movable to and fro in a translatory movement along the movement direction (L). Solely by this straight-line movement forwards and movement backwards of the two bodies all the functions of a pumping cycle are made possible, namely sucking in, conveying or transporting, and discharging, wherein the valve function, too, i.e. opening and closing the inlet opening and the outlet opening, is caused by the two bodies. In particular, no additional rotational movement of the bodies is necessary, as is the case in the reciprocating/rotary piston described in the introduction.

Instead of a straight movement line (L) it is also possible to provide a movement line that is curved in a circular arc shape for the two bodies in the channel. In the serial arrangement (first embodiment) the main body channel can be a channel curved in a circular arc shape or a torus section along the torus circumferential direction, and the sliding bodies can be bodies that are curved in a circular arc shape or in a torus section shape complementary to the channel. In the telescopic arrangement (second embodiment) the main body channel and the sliding body channel of the first sliding body can be channels curved in a circular arc shape or in a torus section shape along the torus circumferential direction, and the first sliding body and the second sliding body can be bodies that are curved in a circular arc shape or in a torus section shape.

Even solely by this curvilinear movement to and fro of the two bodies all the functions of a pumping cycle are made possible, namely sucking in, conveying or transporting, as well as discharging, wherein also the valve function, i.e. opening and closing the inlet opening and the outlet opening is caused by the two bodies. In particular, no additional rotary movement of the bodies is necessary (or even possible) as is the case in the reciprocating/rotary pistons described in the introduction.

It is particularly advantageous if a foaming unit is arranged upstream of the device, with the exit of said foaming unit being in fluid connection with the inlet opening of the device. In this way it is possible to locally produce foamed masses and to provide them in a dosed and/or portioned manner for further use.

The method according to the invention for pumping a flowable mass M1, in particular a flowable consumable item, with the use of a device comprising two sliding bodies, as described above, comprises the following steps:

a) moving the chamber defined by the two sliding bodies to the inlet opening of the main body up to a position in which the chamber is in fluid connection with the inlet opening and the mass source, and in which the chamber has a first chamber volume in that the two sliding bodies are moved in the main body;

b) increasing the chamber volume to a second chamber volume of the chamber positioned at the inlet opening while the chamber is in fluid connection with the inlet opening, in order to suck mass from the mass source into the enlarging chamber in that the two sliding bodies in the main body are moved away from each other;

c) moving the chamber defined by the two sliding bodies away from the inlet opening of the main body up to a position in which the chamber is no longer in fluid connection with the inlet opening and the mass source, and in which the chamber is in fluid connection with the outlet opening and the mass destination, and the chamber has a third chamber volume in that the two sliding bodies are moved in the main body;

d) reducing the chamber volume to a fourth chamber volume of the chamber positioned at the outlet opening while the chamber is in fluid connection with the outlet opening, in order to expel mass from the size reducing chamber to the mass destination in that the two sliding bodies in the main body are moved towards each other.

The method according to the invention for pumping a first flowable mass M1 and a second flowable mass M2, in particular flowable consumable items, with the use of a device comprising three sliding bodies, as described above, comprises the following steps:

a1) moving the chamber defined by the first sliding body and by the second sliding body to the first inlet opening of the main body up to a position in which the first chamber is in fluid connection with the first inlet opening and with the first mass source, and in which the chamber has a first chamber volume; this step takes place in that the first sliding body and/or the second sliding body are/is moved in the main body;

a2) moving the chamber defined by the first sliding body and by the third sliding body to the second inlet opening of the main body up to a position in which the second chamber is in fluid connection with the second inlet opening and the second mass source, and in which the chamber has a first chamber volume; this step takes place in that the first sliding body and the third sliding body are moved in the main body;

b1) increasing the chamber volume to a second chamber volume of the first chamber, positioned at the first inlet opening, while the first chamber is in fluid connection with the first inlet opening, in order to suck mass M1 from the first mass source to the enlarging first chamber; this step takes place in that the first sliding body and the second sliding body are moved away from each other in the main body;

b2) increasing the chamber volume to a second chamber volume of the second chamber, positioned at the second inlet opening, while the second chamber is in fluid connection with the second inlet opening, in order to suck mass M2 from the second mass source to the enlarging second chamber; this step takes place in that the first sliding body and the third sliding body are moved away from each other in the main body;

c1) moving the first chamber defined by the first sliding body and by the second sliding body away from the first inlet opening of the main body up to a position in which the first chamber is not in fluid connection with the first inlet opening and the first mass source, and in which the first chamber is in fluid connection with the first outlet opening and with the mass destination, and the first chamber has a third chamber volume; this step takes place in that the first sliding body and the second sliding body are moved in the main body;

c2) moving away the second chamber, defined by the first sliding body and by the third sliding body, from the second inlet opening of the main body up to a position in which the second chamber is not in fluid connection with the second inlet opening and the second mass source, and in which the second chamber is in fluid connection with the second outlet opening and with the mass destination, and the second chamber has a third chamber volume; this step takes place in that the first sliding body and the third sliding body are moved in the main body;

d1) reducing the chamber volume to a fourth chamber volume of the first chamber positioned at the first outlet opening while the first chamber is in fluid connection with the first outlet opening, in order to expel mass M1 from the size reducing first chamber to the mass destination; this step takes place in that the first sliding body and the second sliding body in the main body are moved towards each other;

d2) reducing the chamber volume to a fourth chamber volume of the second chamber positioned at the second outlet opening while the second chamber is in fluid connection with the second outlet opening, in order to expel mass M2 from the size reducing second chamber to the mass destination; this step takes place in that the first sliding body and the third sliding body in the main body are moved towards each other.

This method makes possible gentle sucking in and discharging of sensitive masses. They can thus be gently pumped and dosed.

In step d) after discharging the mass by reducing the chamber volume to the fourth chamber volume the chamber volume can be slightly increased in that the two sliding bodies in the channel of the main body are slightly moved away from each other. By means of this "retention step" it is possible to prevent uncontrolled dripping of mass at the outlet opening. In this arrangement the slightly increased chamber volume can be the first chamber volume of step a) before said chamber volume is further or again increased in step b).

Expediently, after completion of a step sequence a) to d) a further step sequence a) to d) is implemented.

Particularly advantageously the method according to the invention is used in conjunction with a foaming step, wherein the flowable mass is foamed to form a foamed flowable mass prior to carrying out the step sequence a) to d). Said flowable mass can then be gently pumped so that practically no foam cells or only few foam cells in the mass are destroyed during pumping.

In a particularly advantageous embodiment of the method according to the invention, with the use of the arrangement with three independent sliding bodies or pistons the absolute cyclical or periodic movements of the three sliding bodies (i.e. the movement sequence relative to the stationary main body) take place in a phase-shifted manner. In particular, the cycles or periods of the movement of at least one of the three sliding bodies in terms of the cycles or periods of movement of the other sliding bodies take place in a phase-shifted manner. As a result of this the chronological sequence of the pumping capacity (transported mass volume per unit of time) is different for the two chambers. It is thus, for example, possible to feed a first "shot" of a first dosed quantity of mass M1 to the mass destination, and to feed a second "shot" of a second dosed quantity of mass M1 to the mass destination.

In this arrangement the two masses are preferably supplied to the mass destination by a first channel and a second channel which lie close together, wherein the mass M1 is pumped from the first chamber by way of a first channel, and the mass M2 is pumped from the second chamber by way of a second channel. It is particularly advantageous if one of the two channels is arranged concentrically within the other channel. The channels can comprise circular, oval, triangular or polygonal cross sections. The mass destination can be a hollow shape or alveole. With this arrangement it is possible to produce in the one-shot method confectionary products (pralines, spherical shaped chocolates with smooth centres, etc.) that comprise two different masses.

The invention is not limited to the described arrangements comprising two or three independent sliding bodies but also covers arrangements comprising four or more independently movable sliding bodies or three or more chambers whose position and/or volume can be changed independently of each other. Consequently with each chamber a specific chronological sequence of the pumping capacity or a specific "profile" of the shot of this chamber can be defined. With these arrangements it is possible to produce in the one-shot method confectionary products (pralines, spherical shaped chocolates with smooth centres, etc.) that comprise three or more different masses.

BRIEF DESCRIPTION OF THE DRAWINGS

Further advantages, characteristics and application options of the invention are stated in the following description of two exemplary embodiments of the invention, which are not to be interpreted as being limiting, with reference to the drawing, wherein.

DETAILED DESCRIPTION OF THE PREFERRED EMBODIMENT

Figure 1A:
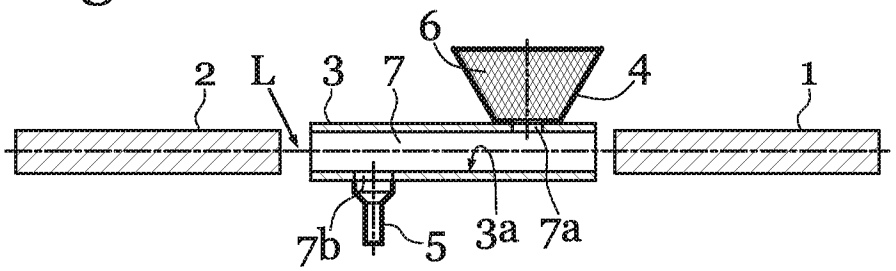
FIG. 1A shows a section view of a first embodiment of the device according to the invention in a disassembled state.

FIGS. 1A-1K show a first embodiment (serial arrangement) of the device according to the invention for pumping a flowable mass. The device comprises a main body 3 having a hollow space 7, which is in fluid connection with a mass source 6 by way of an inlet opening 7*a* and with a mass destination by way of an outlet opening 7*b* in the surroundings of the main body 3. The inlet opening 7*a* and the outlet opening 7*b* are disposed along a direction L at a distance from each other on the main body 3. The device furthermore comprises a first body 1 and a second body 2, both of which can be moved in the main body hollow space 7 relative to the main body 3 and relative to each other along the direction L. The first body 1 and the second body 2 are arranged in such a manner that they rest sealingly against an inside wall 3*a* and slidingly against said inside wall 3*a* and together with the main body hollow space 7 delimit a chamber 8. By moving the first body 1 and/or the second body 2, both the volume of the chamber 8 and the position thereof relative to, or in, the main body 3 can be varied. The mass source 6 is located in a funnel-shaped container 4. It is also possible to arrange several of these devices according to the invention parallel to each other. The mass source 6 can then be designed as an elongated trough-shaped container 4 that extends across all the individual devices and is connected to the inlet opening 7*a* of each device.

The hollow space of the main body comprises a channel 7 with a constant channel cross section. The first body 1 and the second body 2 are designed as sliding bodies that extend over the entire channel cross section and rest sealingly against the inside wall of the main body channel 7 and slidingly against said inside wall. The two sliding bodies 1, 2 in the channel 7 are movable independently of each other along the longitudinal direction L of the channel, so that between the two sliding bodies 1, 2 a chamber 8 is defined whose volume and/or position relative to the main body 3 can be varied by moving the two sliding bodies 1, 2 independently of each other along the longitudinal direction of the channel. This serial arrangement of the sliding bodies 1, 2 makes it possible to provide a functional pumping device with only three essential components 1, 2, 3, of which two 1, 2 can be of identical Shape.

FIGS. 1B-1K show snapshots that show consecutive states of the method according to the invention or consecutive positions of the two sliding bodies 1 and 2 relative to the main body 3 and in particular relative to the inlet opening 7*a* and the outlet opening 7*b* during operation of the first embodiment of the device according to the invention.

Figure 1B:
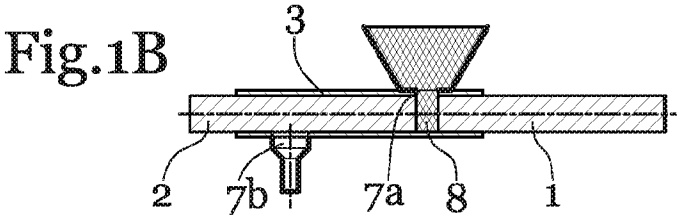
FIGS. 1B-1K show section views of the first embodiment of FIG. 1A which show consecutive snapshots of the method according to the invention with the use of the first embodiment of the device according to the invention.

FIG. 1B shows a snapshot that shows an initial state of the device. The two sliding bodies 1 and 2 are positioned in the main body 3 in such a manner that the facing ends or faces of the first sliding body 1 and of the second sliding body 2 are spaced apart from each other by a relatively small distance, wherein the inlet opening 7*a* is situated between these two faces of the sliding bodies 1 and 2. Between these two ends of the sliding bodies 1, 2 and the inside wall 3*a* (see FIG. 1A) of the main body 3 there is thus the chamber 8 which by way of the inlet opening 7*a* is in fluid connection with the mass source 6. The chamber 8 is full of mass that originates from the preceding pumping cycle. The outlet opening 7*b* is blocked by the sliding body 2 that combines the function of a displacement piston with the function of a valve slide.

Figure 1C:
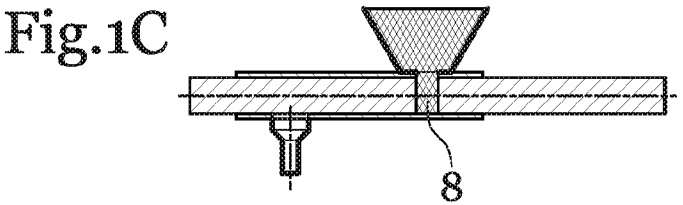
Figure 1D:
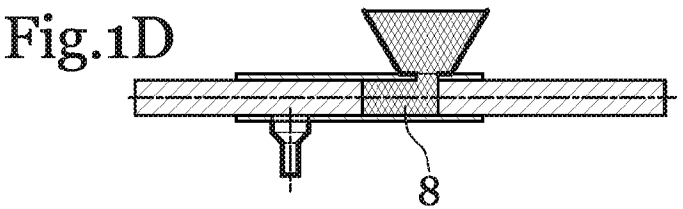

FIGS. 1C and 1D show two consecutive snapshots during the intake stroke. The illustration shows the movement of the second sliding body 2 away from the first sliding body 1 in the interior of the main body 3. While the first sliding body 1 remains in its home position (see FIG. 1B), the second sliding body 2 moves away towards the left-hand side, wherein the inlet opening 7*a* remains open and the outlet opening 7*b* remains blocked. Consequently the volume of the chamber 8 is increased, and further mass is sucked into the chamber 8.

Figure 1E:
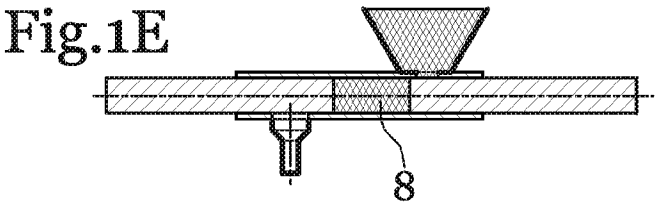
Figure 1F:
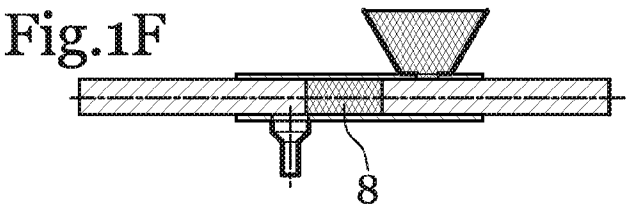

FIGS. 1E and 1F show two consecutive snapshots during a feed stroke. The illustration shows the joint movement of the second sliding body 2 and of the first sliding body 1 in the interior of the main body 3. During this joint movement the distance between the first sliding body 1 and the second sliding body 2 remains constant. This distance corresponds to the distance between the two sliding bodies 1, 2 at the end of the intake stroke (see FIG. 1D). During this feed stroke the inlet opening 7*a* is blocked by the sliding body 1, and the outlet opening 7*b* is blocked by the sliding body 2.

Figure 1G:
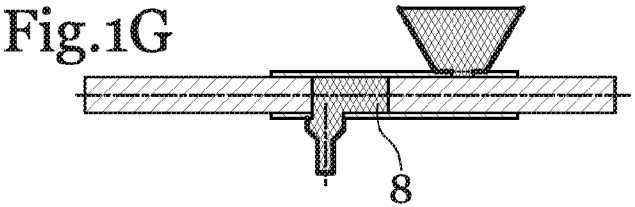

FIG. 1G shows a snapshot that shows the end of a feed stroke and the beginning of the discharge stroke of the device. The inlet opening 7*a* is blocked by the sliding body 1. The chamber 8 is full of the sucked-in mass. The outlet opening 7*b* is no longer blocked by the sliding body 2, and there is a fluid connection to the mass destination to which the pumped mass is delivered in a dosed manner during the then following discharge stroke.

Figure 1H:
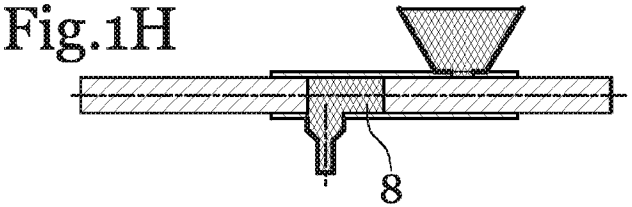
Figure 1I:
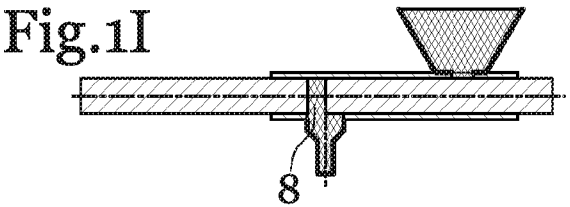

FIGS. 1H and 1I show two consecutive snapshots during the discharge stroke. The illustration shows the forwards movement of the first sliding body 1 to the second sliding body 2 in the interior of the main body 3. While the second sliding body 2 remains at a standstill in its second end position (see FIG. 1G) the first sliding body 1 moves towards the left-hand side, wherein the inlet opening 7*a* remains blocked and the outlet opening 7*b* remains open. Consequently the volume of the chamber 8 is reduced, and mass is discharged from the chamber 8.

Figure 1J:
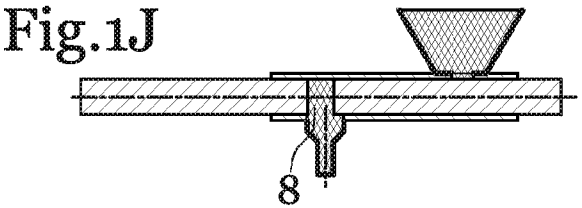

FIG. 1J shows a snapshot that shows the end of a retention stroke of the device. The illustration shows that the volume of the chamber 8 is somewhat increased relative to the volume at the end of the discharge stroke (see FIG. 1I), in that the first sliding body 1 was slightly moved away or withdrawn from the second sliding body 2. The inlet opening 7*a* is blocked by the sliding body 1. The chamber 8 is filled with residual mass that was not discharged during the discharge stroke. By withdrawing one and/or the other of the two sliding bodies 1, 2 from each other, uncontrolled dripping of mass from the open outlet opening 7*b* is prevented.

Figure 1K:
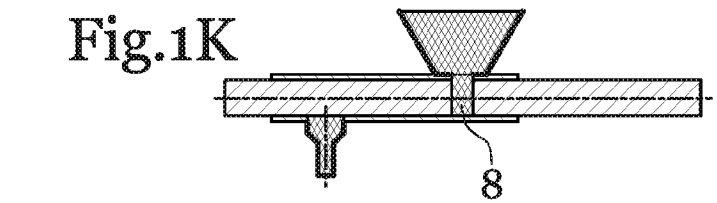

FIG. 1K shows a snapshot that shows the end of a return feed stroke and the renewed beginning of the intake stroke of the device after the two sliding bodies 1, 2, while maintaining a constant distance from each other, have been moved back to the initial position (see FIG. 1B). The inlet opening 7*a* is no longer blocked by the sliding body 1. The chamber 8 is full of the remaining non-discharged mass. The outlet opening 7*b* is again blocked by the sliding body 2, and there is no fluid connection to the mass destination. The pumping cycle shown in FIGS. 1B-1K can commence anew.

Figure 2A:
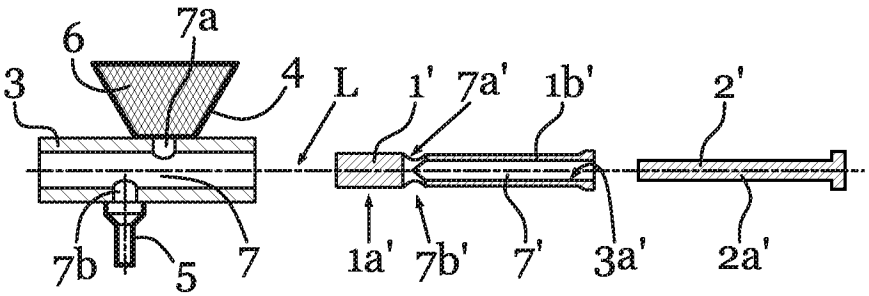
FIG. 2A shows a section view of a second embodiment of the device according to the invention in a disassembled state.

FIG. 2A shows a second embodiment (telescopic arrangement) of the device according to the invention for pumping a flowable mass. As is the case in the first embodiment, the second device comprises a main body 3 with a hollow space 7 that by way of an inlet opening 7*a* is in fluid connection with a mass source 6, and by way of an outlet opening 7*b* is in fluid connection with a mass destination in the surroundings of the sliding body 3. Along a direction L the inlet opening 7*a* and the outlet opening 7*b* are arranged on the main body 3 so as to be spaced apart from each other. As is the case in the first embodiment, the second embodiment, too, furthermore comprises a first body 1' and a second body 2' which are both movable in the main body hollow space 7 relative to the main body 3 and relative to each other along the direction L. As is the case in the first embodiment, the hollow space of the main body 3 comprises a main body channel 7 with a constant channel cross section.

However, in the second embodiment the two bodies 1' and 2' are designed differently and interact in a manner that differs from that of the first embodiment. The first body 1' and the second body 2' are arranged in such a manner that they rest sealingly against an inside wall 3*a* of the main body 3, i.e. in the main body channel 7 or against an inside wall 3*a'* of the first sliding body 1', i.e. in the sliding body channel 7', and slidingly against said inside wall 3*a* or 3*a'*. The body 1' comprises a hollow space that is designed as a sliding body channel 7'. This first body 1' also comprises a first opening 7*a'* and a second opening 7*b'*, by way of which the hollow space of the sliding body channel 7' is connected to the surroundings of the first body 1'.

The first body 1' is designed as a first sliding body that comprises a first longitudinal section 1*a'* that extends over the entire cross section of the main body channel 7. This longitudinal section 1*a'* rests sealingly against the inside wall of the main body channel 7 and slidingly against said inside wall. This first sliding body 1' also comprises a second longitudinal section 1*b'* that comprises the sliding body channel 7' with a constant channel cross section.

The second body 2' is designed as a second sliding body that has a longitudinal section 2*a'* that extends over the entire cross section of the sliding body channel 7' of the second sliding body 2' and rests sealingly against the inside wall 3*a'* of the sliding body channel 7' and slidingly against said inside wall.

The two sliding bodies 1', 2' extend in the channel along a longitudinal direction L of the channel and are also movable independently of each other so that between the two sliding bodies 1', 2' a chamber 8' is determined whose volume and/or position relative to the main body 3 can be altered by moving the two sliding bodies 1', 2' independently of each other along the longitudinal direction L of the channel.

By moving the first body 1' and/or the second body 2' it is possible, as is the case in the first embodiment, to alter both the volume of the chamber 8' and its position relative to, or in, the main body 3. In this embodiment, too, the mass source 6 is in a funnel-shaped container 4, and it is also possible for several of these devices according to the invention to be arranged parallel to each other. In this embodiment, too, the mass source 6 can then be designed as an elongated trough-shaped container 4 that extends across all the individual devices and that is connected to the inlet opening 7*a* of each device.

The telescopic arrangement of the second embodiment distinguishes itself from the serial arrangement of the first embodiment by being more compact in the direction L of the stroke movements.

Figures 2B, 2C, 2D, 2E, 2F, 2G, 2H, 2I, 2J, 2K:
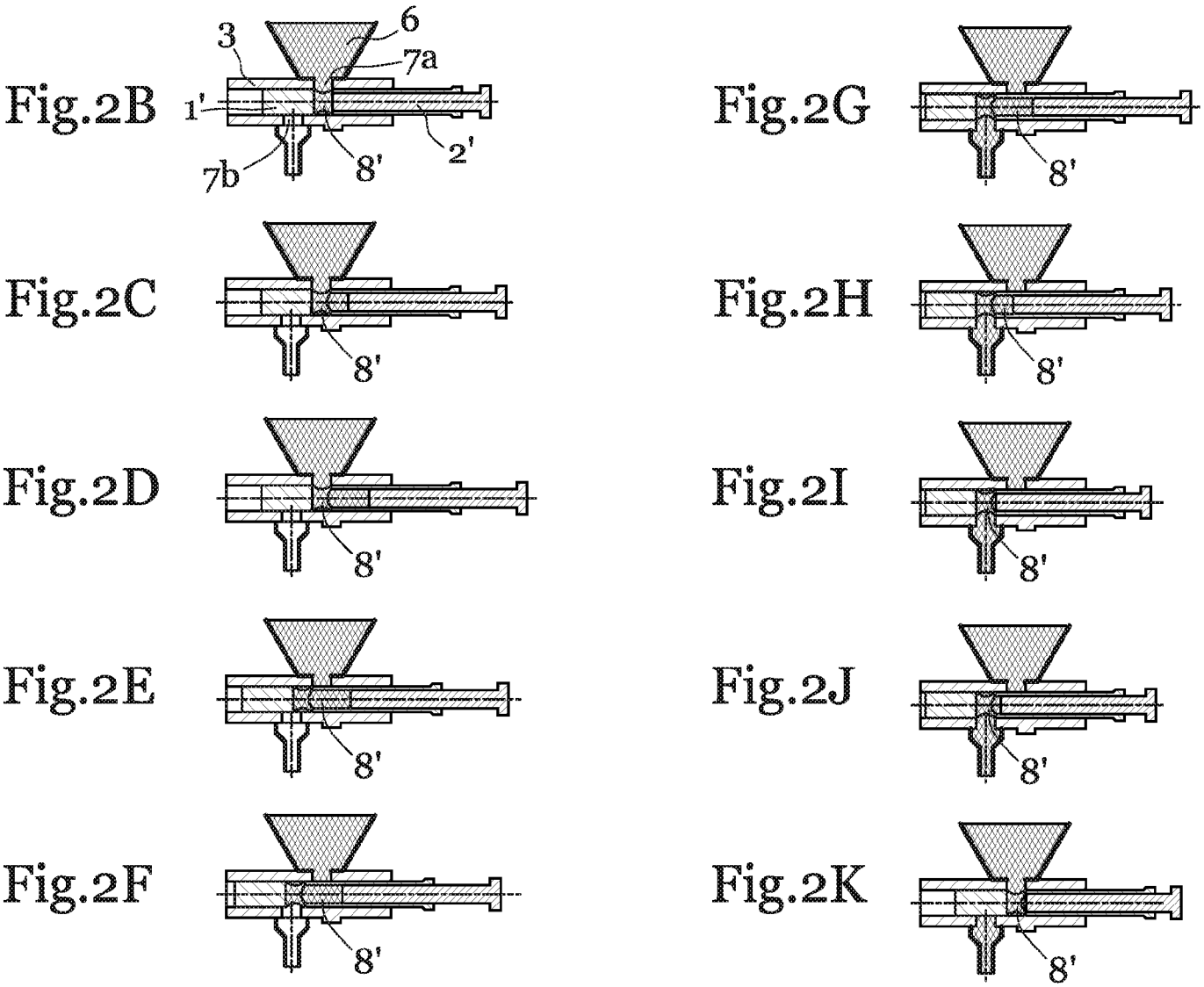
FIGS. 2B-2K show section views of the second embodiment of FIG. 2A which show consecutive snapshots of the method according to the invention with the use of the second embodiment of the device according to the invention.

FIG. 2B shows a snapshot that shows an initial state of the device. The sliding body 1' is positioned in the main body 3 in such a manner that the first opening 7*a'* of the sliding body 1' lines up with the inlet opening 7*a* of the main body 3 or coincides with the aforesaid. There is thus a fluid connection between the chamber 8' and the mass source 6. The outlet opening 7*b* of the main body 3 is blocked by the first longitudinal section 1*a'* of the first sliding body 1'. The facing ends or faces of the second sliding body 2' and of the sliding body channel 7' in the interior of the first sliding body 1' are spaced apart from each other by a relatively small distance. As is the case in the first embodiment, the inlet opening 7*a* of the main body 3 is situated between two faces, namely that of the second sliding body 2' and that of the sliding body channel 7' of the first sliding body 1'. Between these ends or faces there is thus the chamber 8', which by way of the inlet opening 7*a* is in fluid connection with the mass source 6. In this embodiment, too, the chamber 8' is full of mass that originates from the preceding pumping cycle. In this embodiment, too, the sliding body 1' that blocks the outlet opening 7*b* combines the function of a displacement piston with the function of a valve slide.

FIGS. 2C and 2D show two successive snapshots during the intake stroke. The illustration shows the movement of the second sliding body 2' away from the first sliding body 1' in the interior of the sliding body channel 7' (see FIG. 2A). While the first sliding body 1' remains in its home position (see FIG. 2B), the second sliding body 2' moves away towards the right-hand side, wherein the inlet opening 7*a* remains open and the outlet opening 7*b* remains blocked. Consequently the volume of the chamber 8 is increased, and further mass is sucked into the chamber 8'.

FIGS. 2I and 2F show two consecutive snapshots during a feed stroke. The illustration shows the joint movement of the second sliding body 2' and of the first sliding body 1' in the interior of the main body 3. During this joint movement the position of the first sliding body 1' relative to the second sliding body 2' remains constant, i.e. the space between the described faces in the interior of the sliding body channel 7' and thus the volume of the chamber 8' remains constant. In this embodiment, too, this space corresponds to the distance between the two faces at the end of the intake stroke (see FIG. 2D). During this feed stroke the inlet opening 7*a* is blocked by the second longitudinal section 1*b'* of the first sliding body 1', while the outlet opening 7*b* of the main body 3 is already partly overlaid by the second opening 7*b'* of the first sliding body 1' so that the fluid connection to the mass destination has already partly materialised.

FIG. 2G shows a snapshot that shows the end of a feed stroke and the beginning of the discharge stroke of the device. The inlet opening 7*a* is blocked by the sliding body 1'. The chamber 8' is full of the sucked-in mass. The outlet opening 7*b* is no longer blocked by the sliding body 1', and there is a complete fluid connection to the mass destination to which the pumped mass can be fed in a dosed manner during the following discharge stroke.

FIGS. 2H and 2I show two consecutive snapshots during the discharge stroke. The illustration shows the forwards movement of the second sliding body 2' towards the face of the first sliding body 1' in the interior of the sliding body channel 7'. While the first sliding body 1' remains at a standstill in its end position (see FIG. 2G) the second sliding body 2' moves closer towards the left-hand side, wherein the inlet opening 7*a* remains blocked by the second longitudinal section 1*b'* of the first sliding body 1' and the outlet opening 7*b* remains open. Consequently the volume of the chamber 8' is reduced, and mass is discharged from the chamber 8'.

FIG. 2J shows a snapshot that shows the end of a retention stroke of the device. The illustration shows that the volume of the chamber 8' is somewhat increased relative to the volume at the end of the discharge stroke (see FIG. 2I) in that the second sliding body 2' was slightly moved away or withdrawn from the first sliding body 1'. The inlet opening 7*a* is blocked by the sliding body 1'. The chamber 8' is fill of residual mass that was not discharged during the discharge stroke. By withdrawing one and/or the other of the two sliding bodies 1', 2' from each other, uncontrolled dripping of mass from the open outlet opening 7*b* is prevented.

FIG. 2K shows a snapshot that shows the end of a return feed stroke and the renewed beginning of the intake stroke of the device after the two sliding bodies 1', 2', while maintaining a constant distance from each, other have been moved to the initial position (see FIG. 2B). The inlet opening 7*a* is now no longer blocked by the sliding body 1'. The chamber 8' is full of the remaining non-discharged mass. The outlet opening 7*b* is again blocked by the sliding body 1', and there is no fluid connection to the mass destination. The pumping cycle shown in FIGS. 2B-2K can commence anew.

Figure 3A:
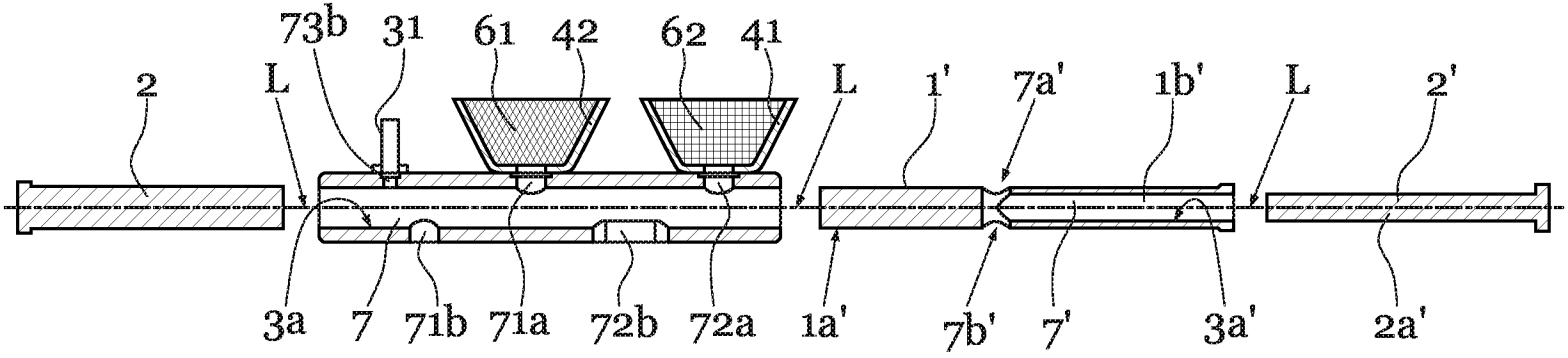
FIG. 3A shows a section view of a third embodiment of the device according to the invention in a disassembled state.

FIG. 3A shows a third embodiment for pumping flowable masses M1 and M2. This third embodiment is a combination of the serial arrangement of FIG. 1A and of the telescopic arrangement of FIG. 2A. The device comprises a main body 3 with a hollow space 7 that by way of a first inlet opening 71*a* is in fluid connection with a first mass source 61, and by way of a second inlet opening 72*a* is in fluid connection with a second mass source 62, and which hollow space 7 by way of a first outlet opening 71*b* and by way of a second outlet opening 72*b* is in fluid connection with a mass destination in the surroundings of the main body 3. Along a direction L the first inlet opening 71*a* and the first outlet opening 71*b* are arranged on the main body 3 so as to be spaced apart from each other. The second inlet opening 72*a* and the second outlet opening 72*b*, too, are arranged along the direction L on the main body 3 so as to be spaced apart from each other.

The device furthermore comprises a first body 1', a second body 2 and a third body 2', which are all movable in the main body hollow space 7 relative to the main body 3 and relative to each other along the direction L.

The first body 1' and the second body 2 are arranged in such a manner that they rest sealingly against an inside wall 3*a* of the main body 3 and slidingly against said inside wall 3*a*, and together with the main body hollow space 7 delimit a first chamber 81. By moving the first body 1' and/or the second body 2, both the volume of the chamber 81 and the position thereof relative to, or in, the main body 3 can be varied. The first mass source 61 is located in a first funnel-shaped container 41.

The first body 1' and the third body 2' are arranged in such a manner that they rest sealingly against the inside wall 3*a* of the main body 3 and slidingly against said inside wall 3*a*, and together with the main body hollow space 7 delimit a second chamber 82. By moving the first body 1' and/or the third body 2', both the volume of the chamber 82 and the position thereof relative to, or in, the main body 3 can be varied. The second mass source 62 is located in a second funnel-shaped container 42.

In this embodiment, too, the hollow space of the main body 3 is a channel 7 with a constant channel cross section. The first body 1' and the second body 2 are designed as sliding bodies that extend over the entire channel cross section and rest sealingly against the inside wall of the main body channel 7 and slidingly against said inside wall. The two sliding bodies 1', 2 in the channel 7 are movable independently of each other along the longitudinal direction L of the channel, so that between the two sliding bodies 1', 2 the first chamber 81 is defined whose volume and/or position relative to the main body 3 can be varied by moving the two sliding bodies 1' 2 independently of each other along the longitudinal direction of the channel. This serial arrangement of the sliding bodies 1', 2 makes it possible to provide a functional pumping device with only three essential components 1', 2, 3.

However, in this third embodiment the first body 1' and the third body 2' are of a different design. Their interaction differs from the interaction of the first body 1' and of the second body 2. The first body 1' and the third body 2' are arranged in such a manner that they rest sealingly against the inside wall 3*a* of the main body 3, i.e. in the main body channel 7, or against an inside wall 3*a'* of the first sliding body 1', i.e. in the sliding body channel 7', sealingly and slidingly against said inside wall 3*a* or 3*a'*. The body 1' comprises a hollow space that is designed as a sliding body channel 7'. The first body 1' also comprises a first opening 7*a'* and a second opening 7*b'*, by way of which the hollow space of the sliding body channel 7' can be made to be in fluid connection with the surroundings of the first body 1'.

The first body 1' is designed as a first sliding body that comprises a first longitudinal section 1*a'* that extends over the entire cross section of the main body channel 7. This longitudinal section 1*a'* rests sealingly against the inside wall of the main body channel 7 and slidingly against said inside wall. This first sliding body 1' also comprises a second longitudinal section 1*b*' that comprises the sliding body channel 7' with a constant channel cross section.

The third body 2' is designed as a third sliding body that has a longitudinal section 2*a*' that extends over the entire cross section of the sliding body channel 7' of the third sliding body 2' and rests sealingly against the inside wall 3*a*' of the sliding body channel 7' and slidingly against said inside wall.

The two sliding bodies 1', 2' extend in the channel along a longitudinal direction L of the channel and are also movable independently of each other so that between the two sliding bodies 1', 2' the chamber 82 is determined whose volume and/or position relative to the main body 3 can be altered by moving the two sliding bodies 1', 2' independently of each other along the longitudinal direction of the channel L.

By moving the first body 1' and/or the third body 2' it is possible to alter both the volume of the chamber 82 and its position relative to, or in, the main body 3. The mass source 62 is located in the second funnel-shaped container 42.

It is also possible for several of these devices according to the invention according to the third embodiment to be arranged so as to be parallel to each other. The mass sources 61 and 62 can then be designed as elongated trough-shaped containers 41 or 42 that extend across all the individual devices and that are connected to the first inlet openings 71*a* or to the second inlet openings 72*a* of each device.

A degassing pipe 31 is affixed to the main body 3, which degassing pipe 31 by way of a third outlet opening 73*b* can be made to be in fluid connection with the first chamber 81. By way of this degassing pipe 31 a gaseous mass M1, which in particular is present as a foam, in the first chamber 81 can be degassed.

FIGS. 3B-3K show snapshots that show consecutive states of the method according to the invention or consecutive positions of the first sliding body 1', of the second sliding body 2, and of the third sliding body 2' relative to the main body 3 and in particular relative to the first inlet opening 71*a* and to the second inlet opening 72*a* as well as relative to the first outlet opening 71*b* and to the second outlet opening 72*b* during operation of the third embodiment of the device according to the invention.

Furthermore, FIGS. 3B-3K show a housing 20 (not shown in FIG. 3A) that comprises a first channel 21 and a second channel 22, which channels extend within the housing 20 in a first sub-region 20*a* of the housing 20 so as to be separate of each other and at a relatively large distance from each other, and which channels meet in a second sub-region 20*b* of the housing 20 and in this second sub-region 20*b* are arranged so as to be congruent, wherein the second channel 22 extends within the first channel 21, or the second channel 22 encloses the first channel 21. Apart from the concentric arrangement, shown in the illustration, of the first channel 21 relative to the second channel 22 in the second sub-region 20*b* of the housing 20 an eccentric arrangement or an adjacent arrangement of the two channels 21, 22 is also possible. The first sub-region 20*a* of the housing 20 is built on the main body 3 in such a manner that the first outlet opening 71*b* and the second outlet opening 72*b* flow into the first channel 21 or into the second channel 22. The two channels 21 and 22, which extend so as to be congruent or adjacent to each other, form a stub line 23 in the second sub-region of the housing 20, which stub line flows into the mass destination.

Figure 3B:
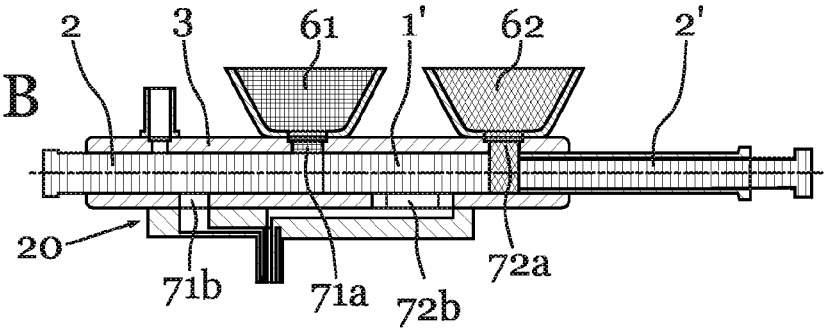
FIGS. 3B-3K show section views of the first embodiment of FIG. 3A which show consecutive snapshots of the method according to the invention with the use of the third embodiment of the device according to the invention.

FIG. 3B shows a snapshot that shows an initial state of the device. The three sliding bodies 1', 2 and 2' are positioned in the main body 3 in such a manner that the facing ends or faces of the sliding bodies 1', 2 and 2' are spaced apart from each other by a relatively small distance, wherein the first inlet opening 71*a* is situated between the faces of the sliding bodies 1' and 2.

Between these two ends of the sliding bodies 1' and 2 and the inside wall 3*a* (see FIG. 3A) of the main body 3 there is thus the first chamber 81 which by way of the inlet opening 71*a* is in fluid connection with the mass source 61. The chamber 81 is full of mass M1 that originates from the preceding pumping cycle. The outlet opening 71*b* is blocked by the sliding body 2 that combines the function of a displacement piston with the function of a valve slide.

The sliding body 1' is positioned in the main body 3 in such a manner that the first opening 7*a*' of the sliding body 1' lines up with the second inlet opening 72*a* of the main body 3 or coincides with the aforesaid. There is thus a fluid connection between the second chamber 82 and the mass source 62. The second outlet opening 72*b* of the main body 3 is blocked by the first longitudinal section 1*a*' of the first sliding body 1'. The facing ends or faces of the second sliding body 2' and of the sliding body channel 7' in the interior of the first sliding body 1' are spaced apart from each other by a relatively small distance. The second inlet opening 72*a* of the main body 3 is situated between these two faces, namely that of the second sliding body 2' and that of the sliding body channel 7' of the first sliding body 1'. Between these ends or faces there is thus the second chamber 82, which by way of the second inlet opening 72*a* is in fluid connection with the mass source 62. In this embodiment, too, the chamber 82 is full of mass M2 that originates from the preceding pumping cycle. In this embodiment, too, the sliding body 1' that blocks the second outlet opening 72*b* combines the function of a displacement piston with the function of a valve slide.

Figure 3C:
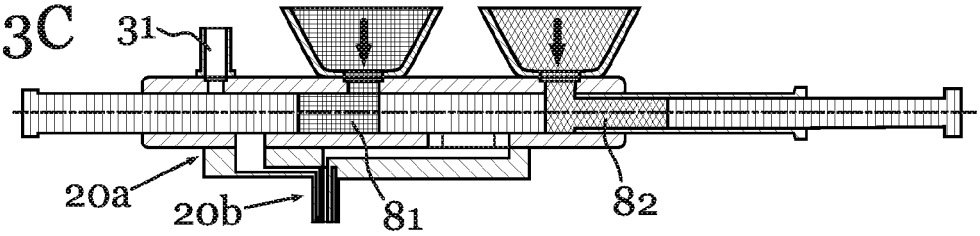
Figure 3D:
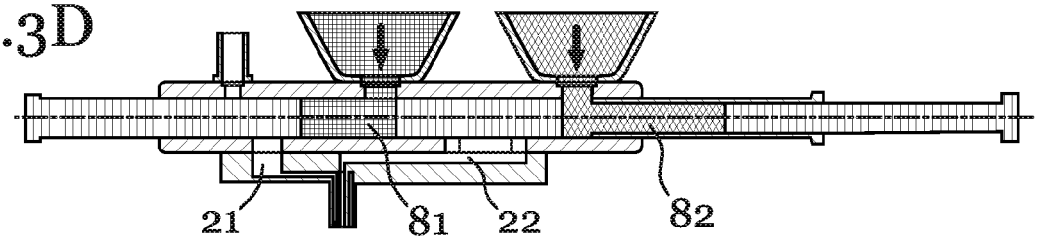

FIGS. 3C and 3D show two successive snapshots during the intake stroke. The illustration shows the movement of the second sliding body 2 away from the first sliding body 1' as well as the movement of the third sliding body 2' away from the first sliding body 1' in the interior of the main body 3. While the first sliding body 1' remains in its home position (see FIG. 3B), the second sliding body 2 moves away towards the left-hand side, wherein the first inlet opening 71*a* remains open and the first outlet opening 71*b* remains blocked. Consequently the volume of the first chamber 81 is increased, and further mass M1 is sucked into the chamber 81. At the same time the third sliding body 2' moves away from the first sliding body 1' in the interior of the sliding body channel 7' (see FIG. 3A). While the first sliding body 1' remains in its home position (see FIG. 3B), the third sliding body 2' moves away towards the right-hand side, wherein the second inlet opening 72*a* remains open and the second outlet opening 72*b* remains blocked. Consequently the volume of the second chamber 82 is increased, and further mass M2 is sucked into the chamber 82.

Figure 3E:
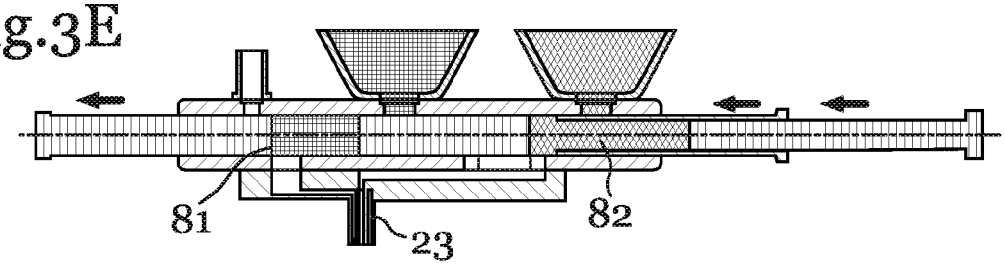

FIGS. 3D and 3E show two consecutive snapshots at the beginning and at the end of a feed stroke. The illustration shows the joint movement of the second sliding body 2 and of the first sliding body 1' in the interior of the main body 3. During this joint movement the distance between the first sliding body 1' and the second sliding body 2 at first remains constant (from FIG. 3D to FIG. 3E). This distance corresponds to the distance between the two sliding bodies 1', 2 at the end of the intake stroke (see FIG. 3D). During this feed stroke the first inlet opening 71*a* is blocked by the first sliding body 1', and the first outlet opening 71*b* is blocked by the second sliding body 2 (from FIG. 3D to FIG. 3E). The illustration also shows the joint movement of the third sliding body 2' and of the first sliding body 1' in the interior of the main body 3. During this joint movement the position of the first sliding body 1' relative to the third sliding body 2' remains constant, i.e. the distance between the described faces in the interior of the sliding body channel 7' and thus the volume of the second chamber 82 remain constant. In this embodiment, too, this distance corresponds to the distance between the two faces at the end of the intake stroke (see FIG. 3D). During this feed stroke the second inlet opening 72*a* is blocked by the second longitudinal section 1*b*' of the first sliding body 1', while the second outlet opening 72*b* of the main body 3 is at first blocked by the first longitudinal section 1*a*' of the first sliding body 1' (see FIG. 3D), while thereafter it is partly overlaid by the second opening 7*b*' of the first sliding body 1' (see FIG. 3E) so that the fluid connection to the mass destination has already partly materialised.

Figure 3F:
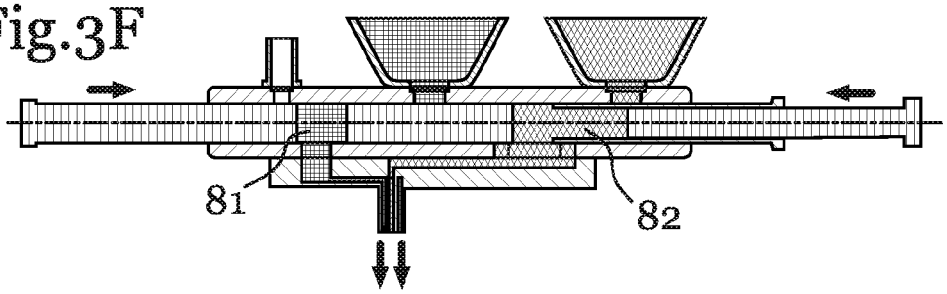
Figure 3G:
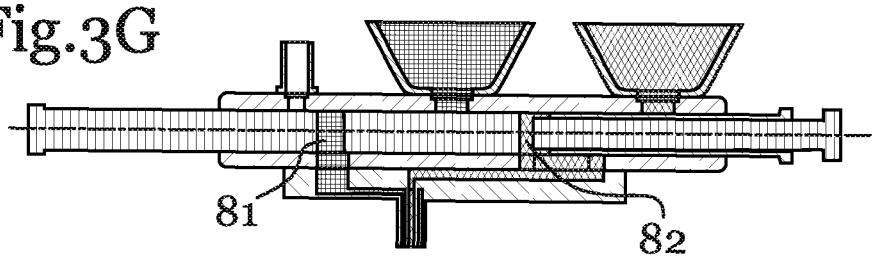

FIG. 3F shows a snapshot that shows the end of a feed stroke and the beginning of the discharge stroke of the device. The first inlet opening 71*a* is blocked by the first sliding body 1'. The chamber 81 is full of the sucked-in mass M1. The first outlet opening 71*b* is no longer blocked by the second sliding body 2, and there is a fluid connection to the mass destination to which the pumped mass M1 can be fed in a dosed manner during the following and subsequently occurring discharge stroke. The second inlet opening 72*a* is just blocked by the first sliding body 1'. The second chamber 82 is full of the sucked-in mass M2. The outlet opening 72*b* is no longer blocked by the first sliding body 1' but is just lined up with the second opening 7*b*' of the first sliding body 1', and consequently a complete fluid connection to the mass destination is established, to which destination the pumped mass M2 can be fed in a dosed manner during the following discharge stroke. The illustration shows the movement of the first sliding body 1' towards the second sliding body 2 in the interior of the main body 3. While the second sliding body 2 remains at a standstill in its end position (see FIG. 3E) the first sliding body 1' moves closer towards the left-hand side, wherein the inlet opening 71*a* remains blocked and the outlet opening 71*b* remains open. Consequently the volume of the first chamber 81 is reduced, and mass M1 is discharged from the chamber 81.

FIGS. 3F and 3E show two consecutive snapshots during the discharge stroke. The illustration shows the further forwards movement of the first sliding body 1' to the second sliding body 2 in the interior of the main body 3. While the second sliding body 2 remains at a standstill in its end position (see FIG. 3E) the first sliding body 1' moves still further towards the left-hand side, wherein the first inlet opening 71*a* remains blocked and the first outlet opening 71*b* remains open. Consequently the volume of the chamber 81 is reduced, and mass M1 is discharged from the chamber 81. The illustration also shows the forwards movement of the third sliding body 2' to the face of the first sliding body 1' in the interior of the sliding body channel 7'. While the first sliding body 1' remains at a standstill in its end position (see FIG. 3E) the third sliding body 2' moves towards the left-hand side towards the aforesaid, wherein the first inlet opening 71*a* remains blocked by the second longitudinal section 1*b*' of the first sliding body 1', and the second outlet opening 72*b* remains open. Consequently the volume of the chamber 82 is reduced, and mass M2 is discharged from the chamber 82.

Figure 3H:
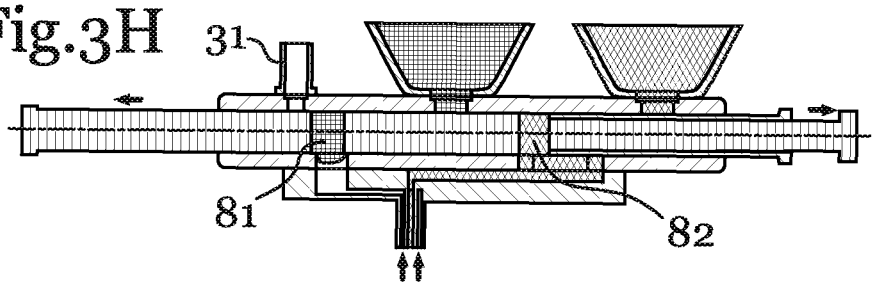

FIG. 3H shows a snapshot that shows the end of a retention stroke (withdrawal of the piston) of the device. The illustration shows that the volume of the first chamber 81 was somewhat increased relative to the volume at the end of the discharge stroke (see FIG. 3E) in that the second sliding body 2 was slightly moved away or withdrawn from the first sliding body 1'. The first inlet opening 71*a* is blocked by the first sliding body 1' while the first outlet opening 71*b* is open. The first chamber 81 is filled with residual mass M1 that was not discharged during the discharge stroke. By withdrawing one and/or the other of the two sliding bodies 1', 2 from each other, uncontrolled dripping of mass M1 from the open first outlet opening 71*b* is prevented. The illustration also shows that the volume of the second chamber 82 is somewhat increased relative to the volume at the end of the discharge stroke (see FIG. 3E) in that the third sliding body 2' was slightly moved away or withdrawn from the first sliding body 1'. The second inlet opening 72*a* is blocked by the first sliding body 1'. The second chamber 82 is full of residual mass M2 that was not discharged during the discharge stroke. By withdrawing one and/or the other of the two sliding bodies 1', 2' from each other, uncontrolled dripping of mass M2 from the open second outlet opening 72*b* is prevented.

Figure 3I:
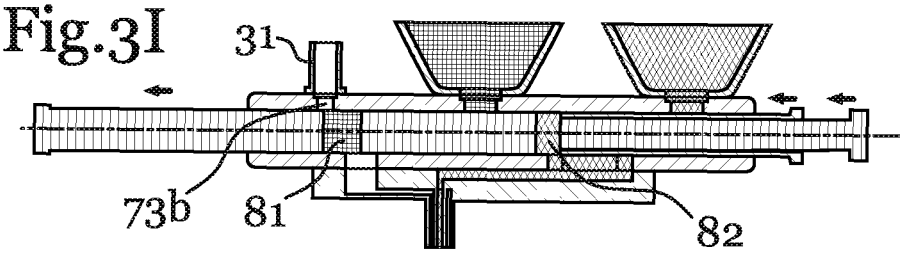
Figure 3J:
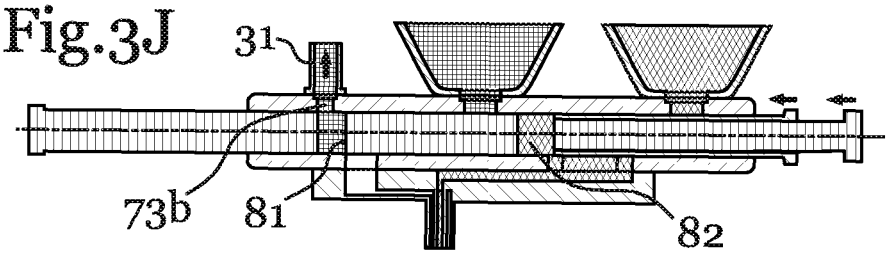
Figure 3K:
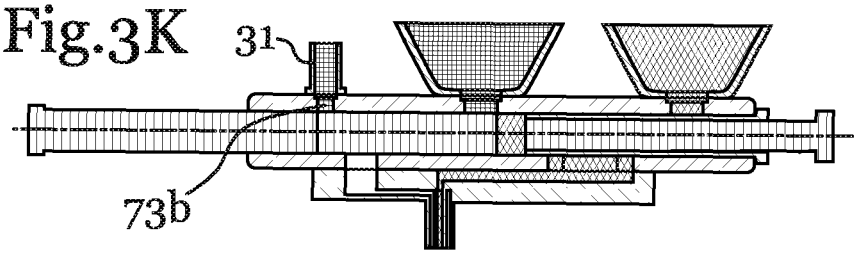

FIGS. 3I, 3J and 3K show consecutive snapshots during a step for expelling gas from the residual mass M1 contained in the first chamber 81. The gas is expelled by way of the degassing pipe 31 affixed to the main body 3. To this extent the outlet opening 73*b* of the degassing pipe 31 is made to be in fluid connection with the first chamber 81.

FIG. 3I shows a snapshot of a feed stroke of the first chamber 81, wherein the first sliding body 1' and the second sliding body 2 are together, e.g. at the same speed, moved towards the left-hand side so that the residual volume of the first chamber 81 full of residual mass M1 remains constant during this feed stroke.

FIG. 3J shows a snapshot of a discharge stroke or compression stroke of the first chamber 81, wherein the second sliding body 2 is stopped after it has released the third outlet opening 73*b* which it had previously blocked. The first sliding body 1' is at the same time moved still further to the left-hand side against the face of the second sliding body 2 so that the residual volume of the first chamber 81 full of residual mass M1 during this compression stroke is gradually reduced. By way of the degassing pipe 31 a gaseous mass M1, which in particular is present as a foam, in the first chamber 81 can be degassed.

FIG. 3K shows a snapshot of the end of the discharge stroke, compression stroke or degassing stroke of the first chamber 81. The first sliding body 1' was moved towards the left-hand side up to the end stop at the face of the second sliding body 2, after which it was then also stopped. The residual volume of the first chamber 81, which is full of residual mass M1, is zero, and the entire residual mass M1, which may be gaseous or foamed, was discharged.

A study, in FIGS. 3B-3H, of the sequence of the intake phases, the feed phases, the discharge phases and the withdrawal phases of the movements of the sliding bodies shows that these phases are not always in complete phase relative to the first chamber 81 and the second chamber 82. Instead, because of the separate drive and the separate control of the first sliding body 1', of the second sliding body 2 and of the third sliding body 2', it is possible to achieve completely individual chronological sequences of the volume and/or of the position of the first chamber 81 and of the second chamber 82. Thus the dosing volume and the dosing time window both relating to the first channel 21 and relating to the second channel 22 can be set very flexibly. In particular with the use of a servomotor for driving each one of the sliding bodies 1', 2 and 2' the dosing quantity or dosing speed at that time can be defined as a function of time. This is particularly advantageous in the production of special confectionary products that are produced from at least two different masses M1 and M2 by practically simultaneous dosing at one mass destination (so-called one-shot products).

Figure 4A:
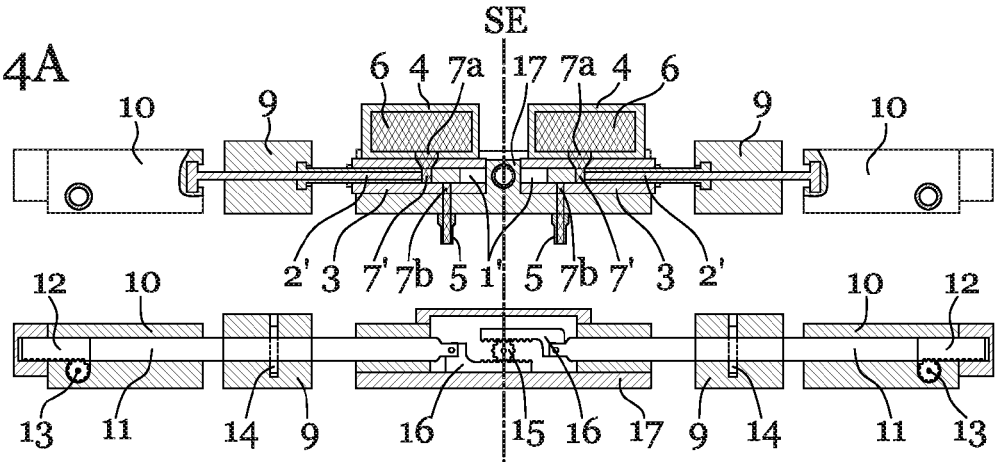
FIGS. 4A-4C show consecutive snapshots of the method according to the invention with the use of a fourth embodiment of the device according to the invention in a first sectional plane and in a second sectional plane that is parallel to the first sectional plane.
Figure 4B:
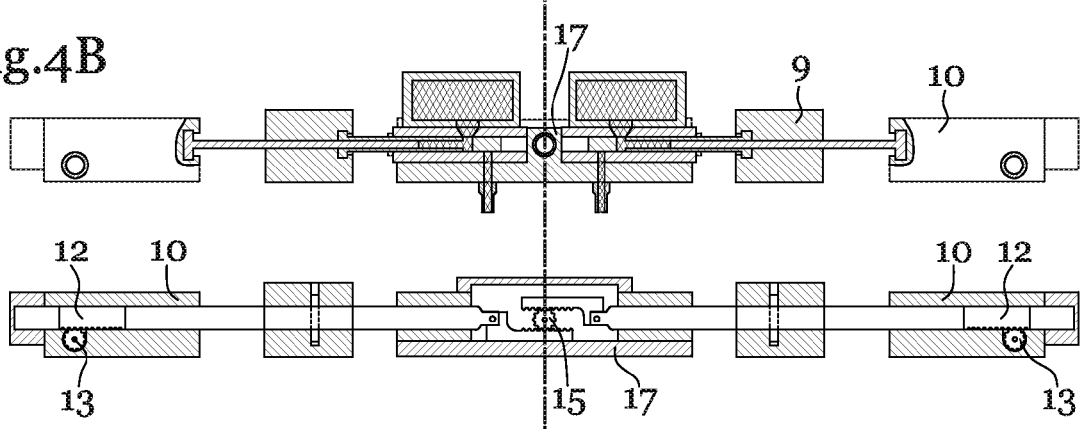
Figure 4C:
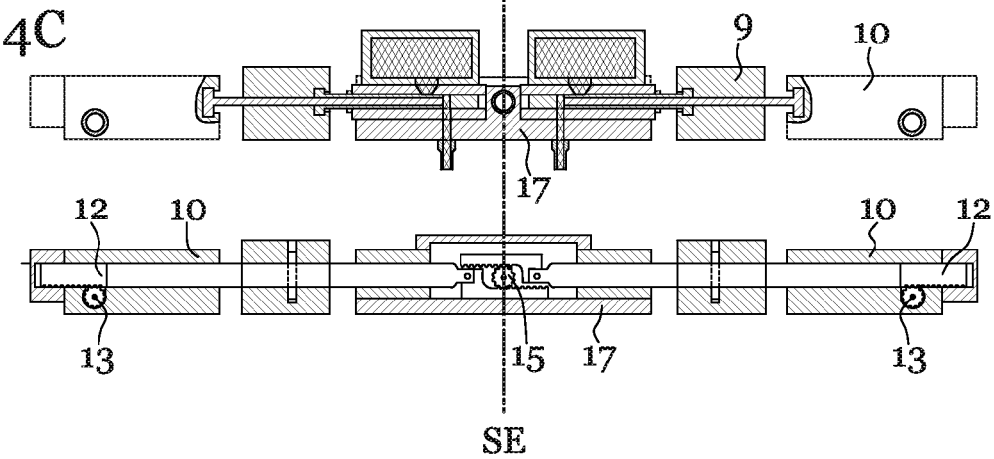

FIGS. 4A-4C show consecutive snapshots of the method according to the invention with the use of a fourth embodiment of the device according to the invention, wherein in the respective upper figure the device is shown in a first sectional plane, and in the respective lower figure the device is shown in a second sectional plane, which is parallel to the first sectional plane.

The device of the fourth embodiment is symmetrical in design. The arrangement of the first sliding body or reversing piston 1' and of the second sliding body or volume piston 2' in FIGS. 4A-4C contains the piston arrangement of the second embodiment, which piston arrangement has been described above with reference to FIG. 2A. The entire arrangement is symmetrical relative to a central vertical symmetry plane SE, wherein the right-hand side of the symmetry plane comprises the piston arrangement of FIG. 2A, and the left-hand side of the symmetry plane comprises the piston arrangement of FIG. 2A, which is mirrored in terms of the symmetry plane SE. The respective first sliding body or reversing piston 1' (see FIG. 2A) comprises a first opening 7*a*' and a second opening 7*b*', which are associated with the respective inlet opening 7*a* or the respective outlet opening 7*b* of the main body 3 on both sides of the symmetry plane SE. The two main bodies 3 as well as all the further elements of the left-hand side and of the right-hand side pump arrangement are arranged in a pump block or pump bar 17 that extends parallel to and between the two piston bars 9. The reversing piston 1' is slidingly held within the main body 3. The second sliding body or volume piston 2' is slidingly held within the sliding body or reversing piston 1'. On the left-hand side and on the right-hand side of the symmetry plane the reversing piston 1' and the volume piston 2' form the telescopic arrangement of FIG. 2A. By way of the respective inlet opening 7*a* the respective container 4 is in fluid connection with the respective chamber 7' within the respective reversing piston 1'. By way of the respective outlet opening 7*b* and a respective line 5 the respective chamber 7' is in fluid connection with the mass destination.

The respective first sliding body or reversing piston 1' on the left-hand side and on the right-hand side of the symmetry plane SE is hooked into a respective first piston bar 9 that extends to the left-hand side or the right hand side of the symmetry plane and parallel thereof. The function of the two piston bars 9 consists of a plurality of reversing pistons 1' that are arranged parallel to each other being hooked into the respective piston bar 9.

The respective second sliding body or volume piston 2' on the left-hand side and on the right-hand side of the symmetry plane SE is hooked into a respective second piston bar 10 that also extends to the left-hand side or the right hand side of the symmetry plane and parallel thereof and is further removed from the aforesaid than is the respective first piston bar 9. The function of the two piston bars 10 consists of a plurality of volume pistons 2' that are arranged parallel to each other being hooked into the respective piston bar 10.

The respective first piston bar 9 is rigidly connected to a respective tie rod 11 by means of a pin 14. At its end facing the symmetry plane SE the respective tie rod 11 is connected in an articulated manner to a respective toothed rack 16. Both toothed racks 16 mesh with a centre pinion 15 that is arranged in the symmetry plane SE and whose axis extends in the symmetry plane. The left-hand side toothed rack 16 is arranged underneath the pinion 15 so as to mesh with it. The right-hand side toothed rack 16 is arranged above the pinion 15 so as to mesh with it. The two toothed racks 16 can be pushed without any play against the pinion 15 with the use of contact pressing means (not shown). When the pinion 15 rotates clockwise, the two toothed racks 11 and thus the two piston bars 9 are moved away from each other. When the pinion 15 rotates counter clockwise, the two toothed racks 11 and thus the two piston bars 9 move towards each other.

The respective second piston bar 10 is slidingly held on the respective tie rod 11. A respective outside pinion 13 is rotatably held in the respective second piston bar 10 and meshes with a respective toothed rack section 12 at the outer end, i.e. the end facing away from the symmetry plane SE, of the respective tie rod 11. When the respective pinion 13 rotates clockwise, the respective piston bar 10 moves relative to its toothed rack 11 towards the left-hand side. When the respective pinion 13 rotates counter clockwise, the respective piston bar 10 moves relative to its toothed rack 11 towards the right-hand side. In addition to these two movements of the piston bars 10 relative to the respective toothed rack 11, in this arrangement the two toothed racks 11 can at the same time carry out a movement relative to the stationary pivot point of the centre pinion 15 or relative to the symmetry plane SE.

The respective tie rod 11 to the left-hand side and the right-hand side of the symmetry plane SE is slidingly held in the centre pump block 17.

Below, an operating cycle or stroke of the fourth embodiment is described.

In the state of FIG. 4A (beginning of the intake stroke) by means of rotation of the pinion 15 and sliding of the respective toothed rack 16 the first opening 7*a*' (FIG. 2A) of the respective chamber 7' (cylinder space) was moved underneath the respective inlet opening 7*a* of the main body 3.

In order to reach the state of FIG. 4B (end of the intake stroke) the respective piston movement 10 is slidingly moved on the respective tie rod 11. To this effect, by means of rotation of the respective pinion 13 that is held in the respective piston bar 10, an unrolling movement of the respective pinion 13 on the respective toothed rack section 12 of the respective tie rod 11 takes place, and consequently the respective piston bar 10 and the volume pistons 2' hooked into it are moved. To achieve this intake stroke of the left-hand side and right-hand side volume piston 2' the pinion 13 on the left-hand side of the symmetry plane SE is rotated clockwise, and the pinion 13 on the right-hand side of the symmetry plane SE is rotated counterclockwise.

In the state of FIG. 4B (end of the intake stroke) the respective piston bar 10 has thus moved away from the respective piston bar 9. Consequently the respective chamber 7' (cylinder space) was increased, and therefore mass 6 was sucked from the respective reservoir 4 through the respective inlet opening 7*a*. When the desired volume of the respective chamber 7' has been achieved, the respective piston bar 10 stands still at its maximum outer position achieved. The drive of the respective pinion 13 stops and stops the respective tie rod 11 by way of its toothed rack section 12 on the respective piston bar 10.

In order to reach the state of FIG. 4C (end of the discharge stroke) the drive of the pinion 15 first moves the respective tie rod 11 by way of its respective toothed rack 16 so that the respective reversing piston 1', which is hooked into the respective piston bar 9, is moved. In this arrangement the second opening 7*b*' (FIG. 2A) of the respective chamber 7' (cylinder space) is moved underneath the respective outlet opening 7*b* of the main body 3. The drive with pinion 15 then stops. The drive of the respective pinion 13 in the respective piston bar 10 subsequently pushes the respective piston bar 10 in such a manner that the respective volume piston 2' hooked into the respective piston bar 10 is moved in the direction of the respective outlet opening 7*b* until the volume piston 2' has discharged the mass 6 from the chamber 7' (cylinder space) by way of the respective line 5.

In order to get back to the state of FIG. 4A (beginning of the intake stroke), the left-hand side drive and the right-hand side drive of the left-hand side or right-hand side pinion 13, by way of the toothed rack section 12 of the respective tie rods 11, stops the respective piston bar 10 on the respective tie rod 11. The drive with the pinion 15 moves the respective piston bar 9 back until the respective reversing piston 1' has reached the home position of FIG. 4A. The stroke has now been completed.

Figure 5A:
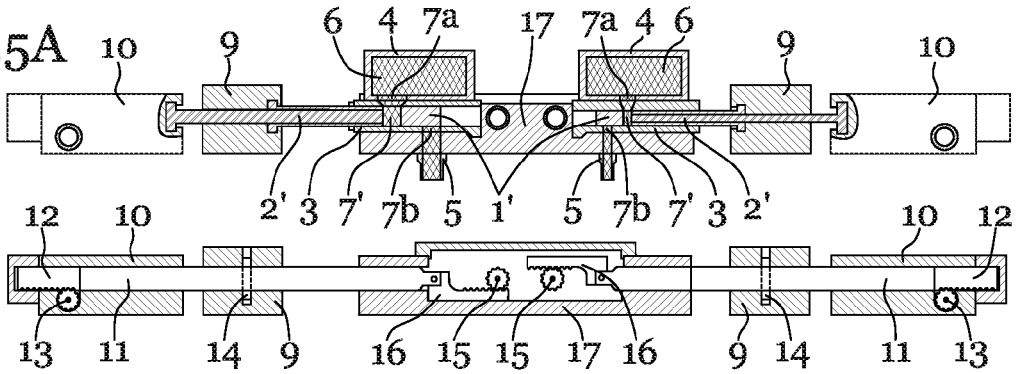
FIGS. 5A-5C show consecutive snapshots of the method according to the invention with the use of a fifth embodiment of the device according to the invention, in each case in a first sectional plane and in a second sectional plane that is parallel to the first sectional plane.
Figure 5B:
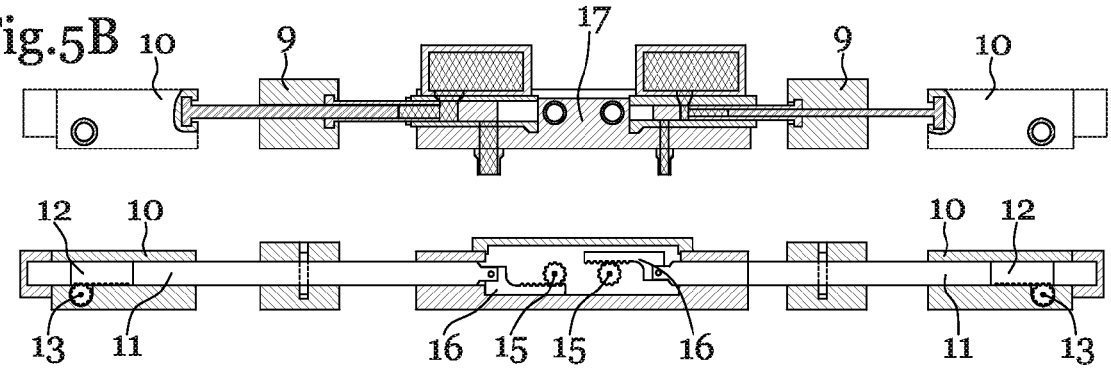
Figure 5C:
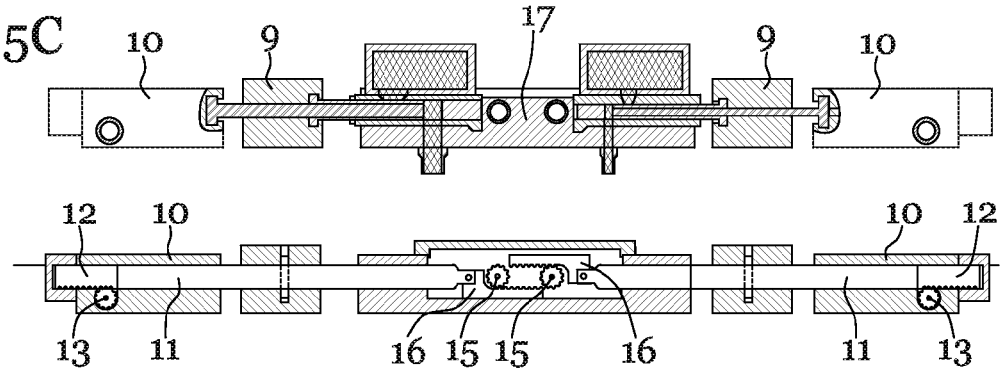

FIGS. 5A-5C show consecutive snapshots of the method according to the invention with the use of a fifth embodiment of the device according to the invention, wherein the respective upper figure shows the device in a first sectional plane, and the respective lower figure shows the device in a second sectional plane that is parallel to the first sectional plane.

The device of the fifth embodiment is similar to that of the fourth embodiment. It differs from the fourth embodiment in that on the one hand it comprises two central pinions 15 that can be driven independently of each other, and in that on the other hand on the left-hand side and on the right-hand side of the symmetry plane SE differently dimensioned pistons 1' and 2' as well as differently dimensioned chambers 7' and differently dimensioned lines 5 are provided.

Consequently the telescopic pump arrangements on the left-hand side and on the right-hand side can be driven fully independently of each other. Furthermore, the illustration shows that by simple exchange of the main body 3, of the reversing piston 1' and of the volume piston 2' within the pump bar the pumping volume of the respective telescopic pump arrangement can be altered. This is particularly advantageous in one-shot applications in which the two lines 5 of a pump pair are brought together at a respective mass destination (compare FIGS. 3B-3K).

The function of the fifth embodiment largely corresponds to that of the fourth embodiment. However, there is a significant difference in that the operating cycles (phases and volumes of the pumping action) of the pump arrangement on the left-hand side can differ from those on the right-hand side.

FIG. 5A shows the state of both pump arrangements at the beginning of the intake stroke, wherein the arrangement on the left-hand side comprises a larger pumping volume (piston stroke x chamber cross section) than does the arrangement on the right-hand side.

FIG. 5B shows the state of both pump arrangements at the end of the intake stroke.

FIG. 5C shows the state of both pump arrangements at the end of the discharge stroke.

In the operating cycle shown in FIGS. 5A-5C the pump arrangements move in phase, i.e. all the intake strokes and discharge strokes take place synchronously without any time offset.

However, in the context of the mentioned one-shot applications it is sensible, and most of the time also necessary, to operate the pump arrangements on the left-hand side and on the right-hand side in an out-of-phase manner relative to each other. Because of the doubly present centre pinion 15 of this design this is easily possible. The pumping volumes are possible by varying the chamber cross section, by exchanging the elements (piston 1', 2', main housing 3 and possibly the line 5) of the respective pump arrangement and/or by varying the piston stroke of the volume piston 2' by means of a change in the control with the use of the pinions 13. The fifth embodiment is therefore particularly flexible in use.

The invention claimed is:

1. A device for pumping a flowable mass, comprising:

a main body having a hollow space having an first inlet opening in fluid connection with a first mass source and a second inlet opening in fluid connection with a second mass source, and said main body being in fluid communication with a mass destination in the surroundings of said main body by a first outlet opening and a second outlet opening, said first inlet opening and said second inlet opening being disposed along a direction at a distance from each other on said main body, and wherein the first outlet opening and the second outlet opening being disposed along the direction at a distance from each other on the main body;

a first body;

a second body;

a third body;

said first body, said second body and said third body being movably disposed in the main body hollow space relative to said main body and relative to each other along the direction, and rest in sealed and slidable relation relative to an inside wall of said main body;

said first body, said second body, and said third body being configured for being separately driven and controlled;

said first body and said second body defining a first chamber, and by movement of at least one of said first body and said second body, both the volume of said first chamber and the position thereof relative to, or in, said main body are variable; and said first body and said third body defining a second chamber, and by movement of at least one of said first body and said third body, both the volume of said second chamber and the position thereof relative to, or in, said main body are variable.

2. The device according to claim 1, wherein the hollow space of said main body includes a channel with a constant channel cross section; said first body and said second body are slidable and extend over the entire channel cross section and rest in sealed and slidable relation against said inside wall; and said first body and said second body are movable independent of each other along a line that extends along the longitudinal direction of the channel, so that at least one of the volume or the position of the first chamber can be altered by independent movement of said first and second bodies relative to said main body along the longitudinal direction of the channel.

3. The device according to claim 2, wherein said first body and said third body are movable independent of each other along a line that extends along the longitudinal direction of the channel, such that at least one of the volume or the position of said second chamber can be altered by independent movement of said first and third bodies relative to said main body along the longitudinal direction of the channel.

4. The device according to claim 1, wherein the hollow space of said main body includes a channel with a constant channel cross section, said first body is a first sliding body that has a first longitudinal section that extends over the entire cross section of said main body channel and rests in sealed and slidable relation against said inside wall; said first sliding body comprises a second longitudinal section that comprises a sliding body channel with a constant channel cross section; said third body is a third sliding body that has a longitudinal section that extends over the entire cross section of the sliding body channel of said first sliding body and rests in sealed and slidable relation against an inside wall of the sliding body channel, and said first sliding body and said third sliding body are movable independent of each other in the channel along a line that extends along the longitudinal direction of the channel, such that at least one of the volume or the position of the second chamber relative to the main body can be varied by moving said first and said third sliding bodies independent of each other along the longitudinal direction of the channel.

5. The device according to claim 1, wherein the hollow space of said main body includes a channel with a constant channel cross section; said first body and said second body are sliding bodies that extend over the entire channel cross section and rest in sealed and slidable relation against said inside wall; and said first sliding body and said second sliding body are movable independent of each other along a line that extends along the longitudinal direction of the channel, such that at least one of the volume or the position of said first chamber relative to said main body can be varied by movement of said first and second sliding bodies independent of each other along the longitudinal direction of the channel; and said first body is a first sliding body that has a first longitudinal section that extends over the entire cross section of the main body channel and rests in sealed and slidable relation against said inside wall; said first sliding body comprises a second longitudinal section that has a sliding body channel with a constant channel cross section; said third body is a third sliding body that has a longitudinal section that extends over the entire cross section of the sliding body channel of said first sliding body and rests in sealed and slidable relation against an inside wall of the sliding body channel, said first sliding body and said third sliding body are movable independent of each other in the channel along a line that extends along the longitudinal direction of the channel such that at least one of the volume or the position of said second chamber relative to said main body can be varied by movement of said first and third sliding bodies independent of each other along the longitudinal direction of the channel.

6. A method of pumping a flowable mass, the method which comprises:

providing a device according to claim 1;

providing a first flowable mass M1 and a second flowable mass M2;

a1) moving the chamber to a position in fluid connection with the first inlet opening and the first mass source, and in which the chamber has a first chamber volume, moving the first sliding body and the second sliding body in the main body;

a2) moving a second chamber to a second inlet opening of the main body to a position in which the second chamber is in fluid connection with the second inlet opening and the second mass source, and in which the chamber has a first chamber volume, by moving the first sliding body and the third sliding body in the main body;

b1) increasing the chamber volume to a second chamber volume of the first chamber, positioned at the first inlet opening while the first chamber is in fluid connection with the first inlet opening, for removing mass M1 from the first mass source to the enlarging first chamber, by moving the first sliding body and the second sliding body away from each other in the main body;

b2) increasing the chamber volume to a second chamber volume of the second chamber, positioned at the second inlet opening while the second chamber is in fluid connection with the second inlet opening, for removing mass M2 from the second mass source to the enlarging second chamber, by moving the first sliding body and the third sliding body away from each other in the main body;

c1) moving away the first chamber, defined by the first sliding body and by the second sliding body, from the first inlet opening to a position in which the first chamber is not in fluid connection with the first inlet opening and the first mass source, and in which the first chamber is in fluid connection with the first outlet opening and the mass destination, and the first chamber has a third chamber volume, by moving the first sliding body and the second sliding body in the main body;

c2) moving away the second chamber, defined by the first sliding body and by the third sliding body, from the second inlet opening of the main body to a position in which the second chamber is not in fluid connection with the second inlet opening and the second mass source, and in which the second chamber is in fluid connection with the second outlet opening and with the mass destination, and the second chamber has a third chamber volume, by moving the first sliding body and the third sliding body in the main body;

d1) reducing the chamber volume to a fourth chamber volume of the first chamber positioned at the first outlet opening while the first chamber is in fluid connection with the first outlet opening, for expelling mass M1 from the size reduced first chamber to the mass destination by moving the first sliding body and the second sliding body towards each other;

d2) reducing the chamber volume to a fourth chamber volume of the second chamber positioned at the second outlet opening while the second chamber is in fluid connection with the second outlet opening, for expelling mass M2 from the size reduced second chamber to the mass destination by moving the first sliding body and the third sliding body towards each other.

* * * * *